US012571539B2

(12) United States Patent
Naik et al.

(10) Patent No.: US 12,571,539 B2
(45) Date of Patent: Mar. 10, 2026

(54) TURBINE ENGINE HAVING A COMBUSTION SECTION WITH A FUEL NOZZLE

(71) Applicant: General Electric Company, Schenectady, NY (US)

(72) Inventors: Pradeep Naik, Bengaluru (IN); Clayton Stuart Cooper, Loveland, OH (US); Karthikeyan Sampath, Bengaluru (IN); Michael A. Benjamin, West Chester, OH (US); Sibtosh Pal, Mason, OH (US); Michael T. Bucaro, Arvada, CO (US); Andrew Joseph Wickersham, Liberty Township, OH (US); Steven C. Vise, Loveland, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/534,029

(22) Filed: Dec. 8, 2023

(65) Prior Publication Data

US 2025/0189133 A1 Jun. 12, 2025

(51) Int. Cl.
*F23R 3/28* (2006.01)

(52) U.S. Cl.
CPC ..... *F23R 3/286* (2013.01); *F23R 3/28* (2013.01)

(58) Field of Classification Search
CPC .. F23R 3/286; F23R 3/14; F23R 3/283; F23R 3/28
See application file for complete search history.

(56) References Cited

U.S. PATENT DOCUMENTS 4,216,652 A * 8/1980 Herman ..... F23D 11/12 239/406
4,408,461 A 10/1983 Bruhwiler et al.
4,815,664 A * 3/1989 Tuthill ..... F23R 3/14 239/404
5,916,142 A * 6/1999 Snyder ..... F23C 7/004 60/800
6,367,262 B1 4/2002 Mongia et al.
7,017,329 B2 3/2006 Farhangi et al.
7,343,745 B2 3/2008 Inoue et al.
(Continued)

FOREIGN PATENT DOCUMENTS

DE 920720 C 11/1954
EP 2442026 A1 4/2012
(Continued)

OTHER PUBLICATIONS

European Search Report dated Apr. 3, 2025 issued in European Patent Application No. 24207343.5 (8 pages).

*Primary Examiner* — Andrew H Nguyen
(74) *Attorney, Agent, or Firm* — Carter, DeLuca & Farrell LLP

(57) ABSTRACT

A turbine engine has a compressor section, a combustion section, and a turbine section in serial flow arrangement. The combustion section has a combustor liner and dome wall collectively forming at least a portion of a combustion chamber. The dome wall has a fuel nozzle opening. The combustion section has a fuel nozzle assembly extending through the fuel nozzle opening. The fuel nozzle assembly has a first body, a second body, a first swirler and a second swirler.

15 Claims, 10 Drawing Sheets

(56) References Cited

U.S. PATENT DOCUMENTS

| | | | | |
|---|---|---|---|---|
| 7,824,165 | B2 | 11/2010 | Davie et al. | |
| 7,891,190 | B2 | 2/2011 | Commaret et al. | |
| 8,066,509 | B2 | 11/2011 | Eroglu et al. | |
| 8,205,452 | B2 | 6/2012 | Boardman et al. | |
| 8,266,911 | B2 | 9/2012 | Evulet | |
| 10,180,256 | B2 | 1/2019 | Rullaud et al. | |
| 10,352,567 | B2 | 7/2019 | Wang et al. | |
| 10,731,861 | B2 * | 8/2020 | Schlein | F23C 7/004 |
| 10,865,989 | B2 | 12/2020 | Sadasivuni | |
| 11,054,137 | B2 | 7/2021 | Choi | |
| 11,085,643 | B2 | 8/2021 | Freeman et al. | |
| 11,466,858 | B2 * | 10/2022 | Freeman | F23R 3/283 |
| 11,635,208 | B2 | 4/2023 | Choi | |
| 11,739,936 | B2 | 8/2023 | Bourgois et al. | |
| 2005/0106520 | A1 | 5/2005 | Cornwell et al. | |
| 2007/0003897 | A1 | 1/2007 | Koizumi et al. | |
| 2009/0000303 | A1 | 1/2009 | Patel et al. | |
| 2009/0111063 | A1 | 4/2009 | Boardman et al. | |
| 2010/0162714 | A1 * | 7/2010 | Rice | F02C 7/22 60/748 |
| 2010/0162716 | A1 | 7/2010 | Bastnagel et al. | |
| 2010/0275604 | A1 | 11/2010 | Hall | |
| 2010/0300102 | A1 | 12/2010 | Bathina et al. | |
| 2011/0162379 | A1 | 7/2011 | Baruah et al. | |
| 2011/0185703 | A1 | 8/2011 | Dodo et al. | |
| 2012/0151928 | A1 | 6/2012 | Patel et al. | |
| 2014/0109582 | A1 | 4/2014 | Shershnyov et al. | |
| 2015/0000299 | A1 | 1/2015 | Zuo et al. | |
| 2015/0253010 | A1 | 9/2015 | Schlein | |
| 2016/0010864 | A1 | 1/2016 | Abe et al. | |
| 2016/0161122 | A1 * | 6/2016 | Zink | F23R 3/14 60/748 |
| 2016/0290646 | A1 | 10/2016 | Abe et al. | |
| 2016/0377293 | A1 | 12/2016 | Short et al. | |
| 2017/0108223 | A1 * | 4/2017 | Ryon | F23R 3/12 |
| 2017/0248313 | A1 * | 8/2017 | Hannwacker | F23R 3/007 |
| 2017/0307218 | A1 | 10/2017 | Miyauchi et al. | |
| 2017/0350598 | A1 * | 12/2017 | Boardman | F23R 3/14 |
| 2018/0299129 | A1 | 10/2018 | Parsania et al. | |
| 2019/0086088 | A1 * | 3/2019 | Stevens | F23R 3/50 |
| 2019/0137103 | A1 | 5/2019 | Choi | |
| 2019/0234615 | A1 | 8/2019 | Stevens et al. | |
| 2019/0271470 | A1 * | 9/2019 | Boardman | F23R 3/283 |
| 2020/0041129 | A1 * | 2/2020 | Pal | F23R 3/14 |
| 2020/0248903 | A1 * | 8/2020 | Sampath | F23R 3/14 |
| 2022/0356845 | A1 * | 11/2022 | Morenko | F23R 3/28 |
| 2022/0364509 | A1 * | 11/2022 | Morenko | F02C 7/22 |
| 2022/0412563 | A1 | 12/2022 | Giridharan et al. | |
| 2023/0053389 | A1 | 2/2023 | Vukanti et al. | |
| 2023/0204213 | A1 | 6/2023 | Naik et al. | |
| 2023/0204215 | A1 | 6/2023 | Naik et al. | |
| 2023/0296245 | A1 | 9/2023 | Kim et al. | |
| 2023/0366551 | A1 | 11/2023 | Vukanti et al. | |
| 2024/0288168 | A1 * | 8/2024 | Dai | F23R 3/286 |

FOREIGN PATENT DOCUMENTS

| | | | |
|---|---|---|---|
| EP | 4083511 | A1 | 11/2022 |
| EP | 4202302 | A1 | 6/2023 |
| EP | 4202303 | A1 | 6/2023 |
| WO | 2013/065624 | A1 | 11/2010 |
| WO | 2023/180318 | A1 | 9/2023 |

* cited by examiner

TURBINE ENGINE HAVING A COMBUSTION SECTION WITH A FUEL NOZZLE

TECHNICAL FIELD

The present subject matter relates generally to a turbine engine, and more specifically to a turbine engine having a combustion section including a fuel nozzle.

BACKGROUND

Turbine engines are driven by a flow of combustion gases passing through the engine to rotate a multitude of turbine blades, which, in turn, rotate a compressor to provide compressed air to the combustor for combustion. A combustor can be provided within the turbine engine and is fluidly coupled with a turbine into which the combusted gases flow.

The use of hydrocarbon fuels in the combustor of a turbine engine is known. Generally, air and fuel are fed to a combustion chamber, the air and fuel are mixed, and then the fuel is burned in the presence of the air to produce hot gas. The hot gas is then fed to a turbine where it cools and expands to produce power. By-products of the fuel combustion typically include environmentally unwanted byproducts, such as nitrogen oxide and nitrogen dioxide (collectively called $NO_x$), carbon monoxide (CO), unburned hydrocarbon (UHC) (e.g., methane and volatile organic compounds that contribute to the formation of atmospheric ozone), and other oxides, including oxides of sulfur (e.g., $SO_2$ and $SO_3$).

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
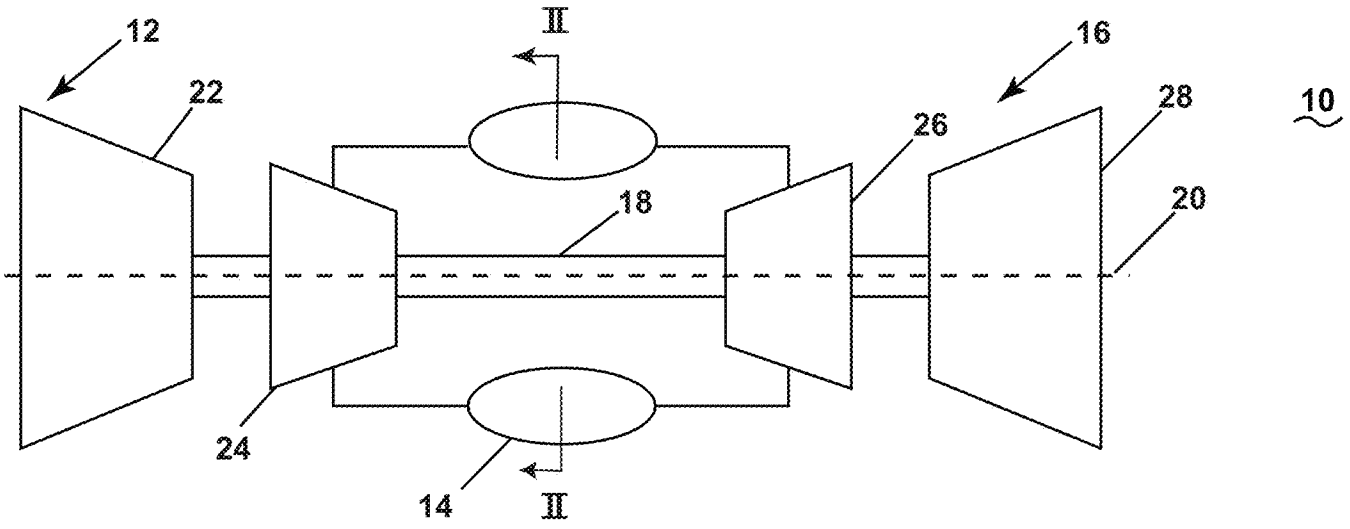
FIG. 1 is a schematic representation of a turbine engine, the turbine engine including a compressor section, a combustion section, and a turbine section.

Aspects of the disclosure described herein are directed to a turbine engine including a combustion section including a fuel nozzle assembly. The fuel nozzle assembly includes a fuel nozzle having a first body. The fuel nozzle assembly includes a second body and a third body. The first body defines a gaseous fuel channel. A first compressed air channel is defined between the first body and the second body. A second compressed air channel is defined between the third body and the second body.

The fuel nozzle assembly is especially well adapted for the use of hydrogen fuel (hereinafter, "H2 fuel"). Specifically, the fuel nozzle assembly is especially well adapted to feed a flow of gaseous H2 fuel to the combustion chamber. H2 fuels, when compared to traditional fuels (e.g., carbon fuels, petroleum fuels, etc.), have a higher burn temperature and velocity. Further, flashback can occur when using H2 fuels. As used herein, flashback refers to unintended flame propagation when the H2 fuel is combusted. H2 fuel has higher volatility, meaning that once the H2 fuel is combusted or ignited, the flame generated by the ignition of the H2 fuel can expand in undesired location; in other words, flashback can occur. For example, the flame can expand into the fuel nozzle or igniter. The fuel nozzle assembly, as described herein, ensures flashback of the H2 fuel does not occur. Auto-ignition of the H2 fuel can occur if the H2 fuel is too hot. Auto-ignition of the H2 fuel can be undesirable in certain locations of the combustion section. The fuel nozzle assembly as described herein ensures that the temperature of the H2 fuel is below the auto-ignition temperature until at least when it is desired to ignite the H2 fuel.

As used herein, the term "gaseous fuel" or iterations thereof reefers to a combustible fuel in a gaseous state. It will be appreciated that gaseous fuel is different from atomized fuel. Atomized fuel utilizes an impeller, orifices, or the like to take a liquid fuel and atomize the liquid fuel into very small droplets.

In some aspects, the gaseous fuel exits the fuel nozzle with a given speed and then mixes with air for combustion. As the fuel/air mixture burns, the flame propagates upstream. It can be desirable to control or maintain a constant flame in the combustor for ignition of subsequent fuel, and not to continually ignite the fuel with an ignitor.

For purposes of illustration, the present disclosure will be described with respect to a turbine engine (gas turbine engine). It will be understood, however, that aspects of the disclosure described herein are not so limited and that a fuel nozzle assembly as described herein can be implemented in engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first" and "second" may be used interchangeably to distinguish one component from another and are not intended to signify location or importance of the individual components.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

As used herein, the term "radius of curvature" equals the radius of a circular arc which best approximates the curve at that point. A linear, or flat surface has a radius of curvature of zero. A curved surface, therefore, has a non-zero radius of curvature.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16 in serial flow arrangement. A drive shaft 18 rotationally couples the compressor section 12 and the turbine section 16, such that rotation of one affects the rotation of the other, and defines a rotational axis or engine centerline 20 for the turbine engine 10.

The compressor section 12 can include a low-pressure (LP) compressor 22, and a high-pressure (HP) compressor 24 serially fluidly coupled to one another. The turbine section 16 can include an LP turbine 26, and an HP turbine 28 serially fluidly coupled to one another. The drive shaft 18 can operatively couple the LP compressor 22, the HP compressor 24, the LP turbine 26 and the HP turbine 28 together. Alternatively, the drive shaft 18 can include an LP drive shaft (not illustrated) and an HP drive shaft (not illustrated). The LP drive shaft can couple the LP compressor 22 to the LP turbine 26, and the HP drive shaft can couple the HP compressor 24 to the HP turbine 28. An LP spool can be defined as the combination of the LP compressor 22, the LP turbine 26, and the LP drive shaft such that the rotation of the LP turbine 26 can apply a driving force to the LP drive shaft, which in turn can rotate the LP compressor 22. An HP spool can be defined as the combination of the HP compressor 24, the HP turbine 28, and the HP drive shaft such that the rotation of the HP turbine 28 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section 16 can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 28 at a downstream end of the combustion section 14.

During operation of the turbine engine 10, ambient or atmospheric air is drawn into the compressor section 12 via a fan (not illustrated) upstream of the compressor section 12, where the air is compressed defining a compressed air. The compressed air can then flow into the combustion section 14 where the compressed air is mixed with fuel and ignited, thereby generating combustion gases. Some work is extracted from these combustion gases by the HP turbine 28, which drives the HP compressor 24. The combustion gases are discharged into the LP turbine 26, which extracts additional work to drive the LP compressor 22, and the exhaust gas is ultimately discharged from the turbine engine 10 via an exhaust section (not illustrated) downstream of the turbine section 16. The driving of the LP turbine 26 drives the LP spool to rotate the fan (not illustrated) and the LP compressor 22. The compressed airflow and the combustion gases can together define a working airflow that flows through the fan, compressor section 12, combustion section 14, and turbine section 16 of the turbine engine 10.

Figure 2:
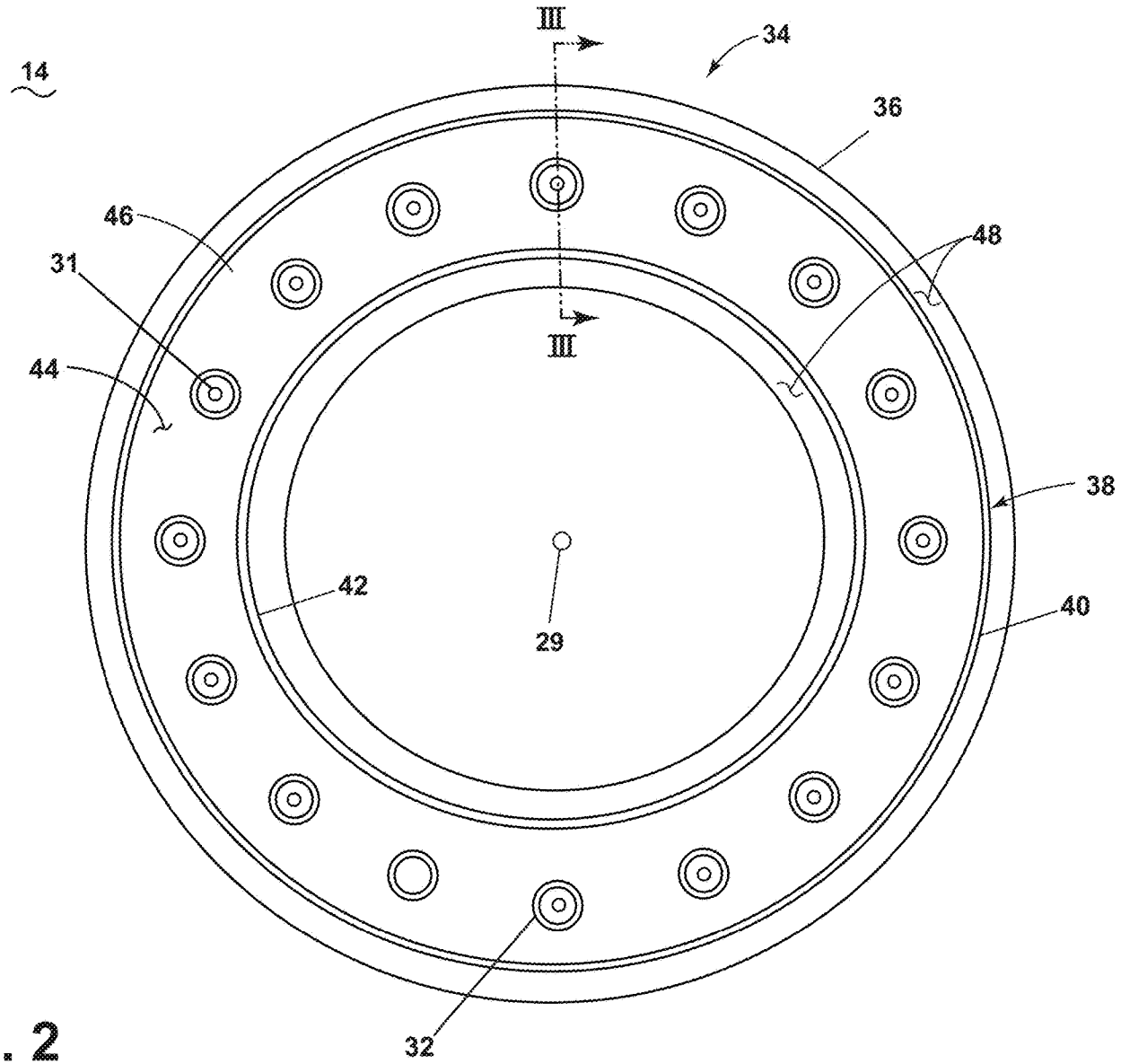
FIG. 2 depicts a cross-section view of the combustion section taken along line II-II of FIG. 1, further illustrating a set of fuel nozzles.

FIG. 2 depicts a cross-sectional view of the combustion section 14 along line II-II of FIG. 1. For purposes of illustration, the drive shaft 18 (FIG. 1) has been removed. The combustion section 14 includes a combustor 34. The combustor 34 includes a dome wall 44 including a set of fuel nozzle openings (not illustrated). The combustor 34 includes a set of fuel nozzles 32 extending through the set of fuel nozzle openings. The set of fuel nozzles 32 annularly arranged about a combustor centerline 29. The combustor centerline 29 can be the engine centerline 20 of the turbine engine 10. Additionally, or alternatively, the combustor centerline 29 can be a centerline for the combustion section 14, a single combustor, or a set of combustors that are arranged about the combustor centerline 29.

The set of fuel nozzles 32 are arranged about the combustor centerline 29. Each fuel nozzle of the set of fuel nozzles 32 includes a fuel nozzle centerline 31. The set of fuel nozzles 32 can include rich cups, lean cups, or a combination of both rich and lean cups annularly provided about the engine centerline 20 (FIG. 1). The combustor 34 is defined by a combustor liner 38. The combustor 34 can have a can, can-annular, or annular arrangement depending on the type of engine in which the combustor 34 is located. In a non-limiting example, the combustor 34 can have a combination arrangement as further described herein located within a casing 36 of the engine. The combustor liner 38, as illustrated by way of example, can be annular. The combustor liner 38 can include an outer combustor liner 40 and an inner combustor liner 42 concentric with respect to each other and annular about the engine centerline 20. The combustor liner 38 further defines the set of fuel nozzles 32. The dome wall 44 together with the combustor liner 38 can define a combustion chamber 46 annular about the engine centerline 20. The set of fuel nozzles 32 can be fluidly coupled to the combustion chamber 46. A compressed air passageway 48 can be defined at least in part by both the combustor liner 38 and the casing 36. Each fuel nozzle of the set of fuel nozzles 32 is defined by a discrete body extending through a respective portion of the dome wall 44 and being configured to exhaust a flow of gaseous fuel and compressed air into the combustion chamber 46.

Figure 3:
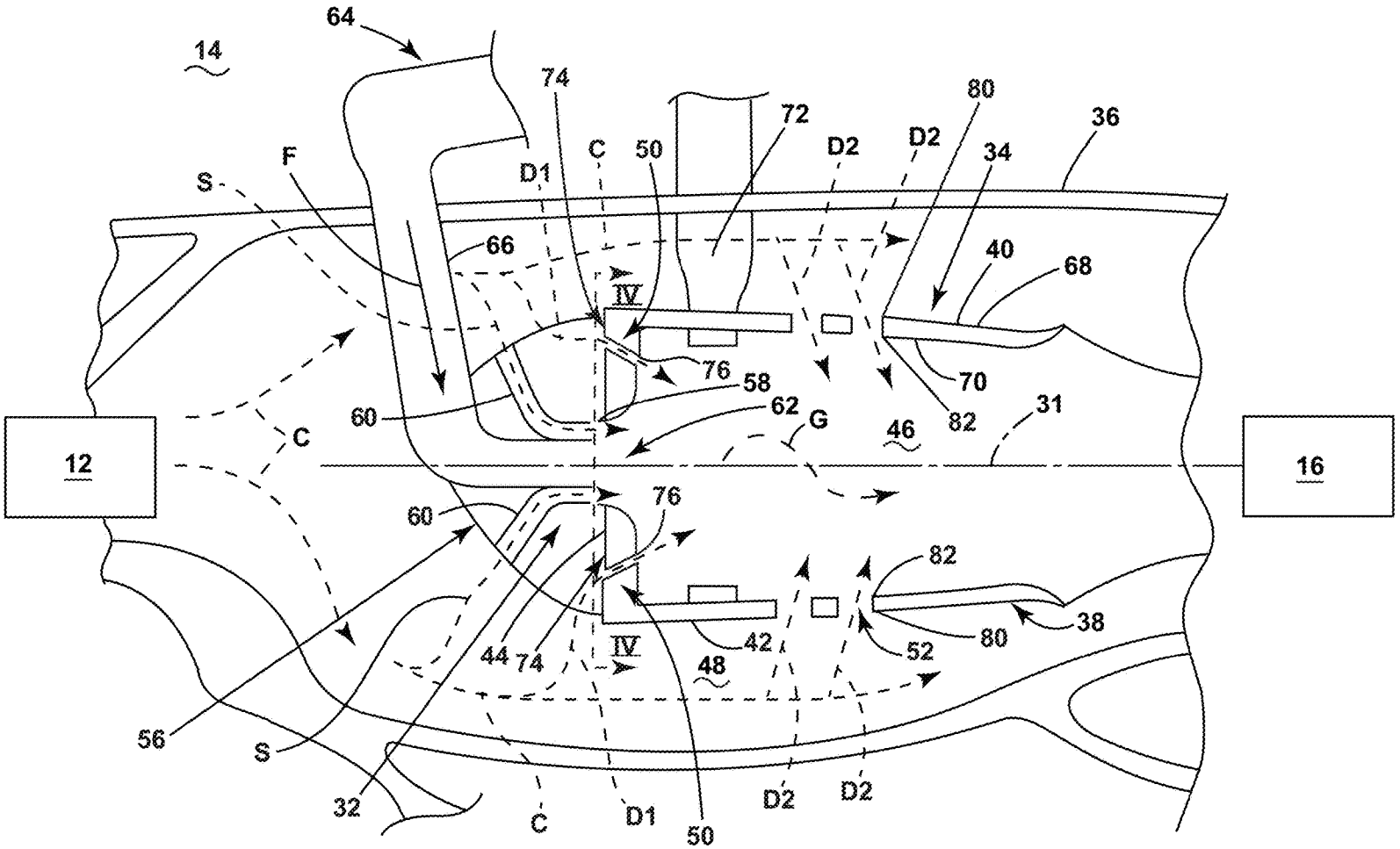
FIG. 3 is a schematic of a side cross-sectional view taken along line III-III of FIG. 2, further illustrating a fuel nozzle exhausting into a combustion chamber.

FIG. 3 depicts a cross-section view taken along line III-III of FIG. 2 illustrating the combustion section 14. At least one flame shaping passage can fluidly connect compressed air and the combustion chamber 46. By way of example, the at least one flame shaping passage is illustrated as first set of flame shaping holes 50 or second first set of flame shaping holes 52. The combustor 34 can include the first set of flame shaping holes 50, the second first set of flame shaping holes 52, or both the first set of flame shaping holes 50 and the second first set of flame shaping holes 52.

The first set of flame shaping holes 50 can pass through the dome wall 44, fluidly coupling compressed air from the compressor section 12 or the compressed air passageway 48 to the combustion chamber 46.

The second first set of flame shaping holes 52 can pass through the combustor liner 38, fluidly coupling compressed air from the compressed air passageway 48 to the combustion chamber 46.

The fuel nozzle 32 can be coupled to and disposed within a dome assembly 56. The fuel nozzle 32 can include a flare cone 58 and a swirler 60. The flare cone 58 includes an outlet 62 of the fuel nozzle 32 directly fluidly coupled to the combustion chamber 46. The fuel nozzle 32 is fluidly coupled to a fuel inlet 64 via a passageway 66. The fuel nozzle centerline 31 can be defined by the fuel nozzle 32, the flare cone 58, or the outlet 62.

Both the inner combustor liner 42 and the outer combustor liner 40 can have an outer surface 68 and an inner surface 70 at least partially defining the combustion chamber 46. The combustor liner 38 can be made of one continuous monolithic portion or be multiple monolithic portions assembled together to define the inner combustor liner 42 and the outer combustor liner 40. By way of non-limiting example, the outer surface 68 can define a first piece of the combustor liner 38 while the inner surface 70 can define a second piece of the combustor liner 38 that when assembled together form the combustor liner 38. As described herein, the combustor liner 38 includes the second first set of flame shaping holes 52. It is further contemplated that the combustor liner 38 can be any type of combustor liner 38, including but not limited to a single wall or a double walled liner or a tile liner. An ignitor 72 can be provided at the combustor liner 38 and fluidly coupled to the combustion chamber 46, at any location, by way of non-limiting example upstream of the second first set of flame shaping holes 52.

During operation, a compressed air (C) from a compressed air supply, such as the LP compressor 22 or the HP compressor 24 of FIG. 1, can flow from the compressor section 12 to the combustor 34. A portion of the compressed air (C) can flow through the dome assembly 56. A first part of the compressed air (C) flowing through the dome assembly 56 can be fed to the fuel nozzle 32 via the swirler 60 as a swirled airflow(S). A flow of fuel (F) is fed to the fuel nozzle 32 via the fuel inlet 64 and the passageway 66. The swirled airflow(S) and the flow of fuel (F) are mixed at the flare cone 58 and fed to the combustion chamber 46 as a fuel/air mixture. The ignitor 72 can ignite the fuel/air mixture to define a flame within the combustion chamber 46, which generates a combustion gas (G). While shown as starting axially downstream of the outlet 62, it will be appreciated that the fuel/air mixture can be ignited at or near the outlet 62.

A second part of the compressed air (C) flowing through one or more portions of the dome assembly 56 can be fed to the first set of flame shaping holes 50 as a first flame shaping airflow (D1). That is, a portion of the compressed air (C) from the compressor section 12 can flow through the dome wall 44 and into the combustion chamber 46 by passing through the first set of flame shaping holes 50. An inlet 74 is defined by a portion of one or more flame shaping holes of the first set of flame shaping holes 50. The inlet 74 is fluidly coupled to the compressed air (C). The first flame shaping airflow (D1) enters the one or more flame shaping holes of the first set of flame shaping holes 50 at the inlet 74 and exits the one or more flame shaping holes of the first set of flame shaping holes 50 at an outlet 76 located at the dome wall 44.

Another portion of the compressed air (C) can flow through the compressed air passageway 48 and can be fed to the second first set of flame shaping holes 52 as a second flame shaping airflow (D2). In other words, another portion of the compressed air (C) can flow axially past the dome assembly 56 and enter the combustion chamber 46 by passing through the second first set of flame shaping holes 52. That is, compressed air (C) can flow through the combustor liner 38 and into the combustion chamber 46 by passing through the second first set of flame shaping holes 52.

The first flame shaping airflow (D1) can be used to direct and shape the flame. The second flame shaping airflow (D2) can be used to direct the combustion gas (G). In other words, the first set of flame shaping holes 50 or the second first set of flame shaping holes 52 extending through the dome wall 44 or the combustor liner 38 direct air into the combustion chamber 46, where the directed air is used to control, shape, cool, or otherwise contribute to the combustion process in the combustion chamber 46.

The combustor 34 shown in FIG. 3 is well suited for the use of a hydrogen-containing gas as the fuel because it helps contain the faster moving flame front associated with hydrogen fuel, as compared to traditional hydrocarbon fuels. However, the combustor 34 can be used with traditional hydrocarbon fuels.

Figure 4:
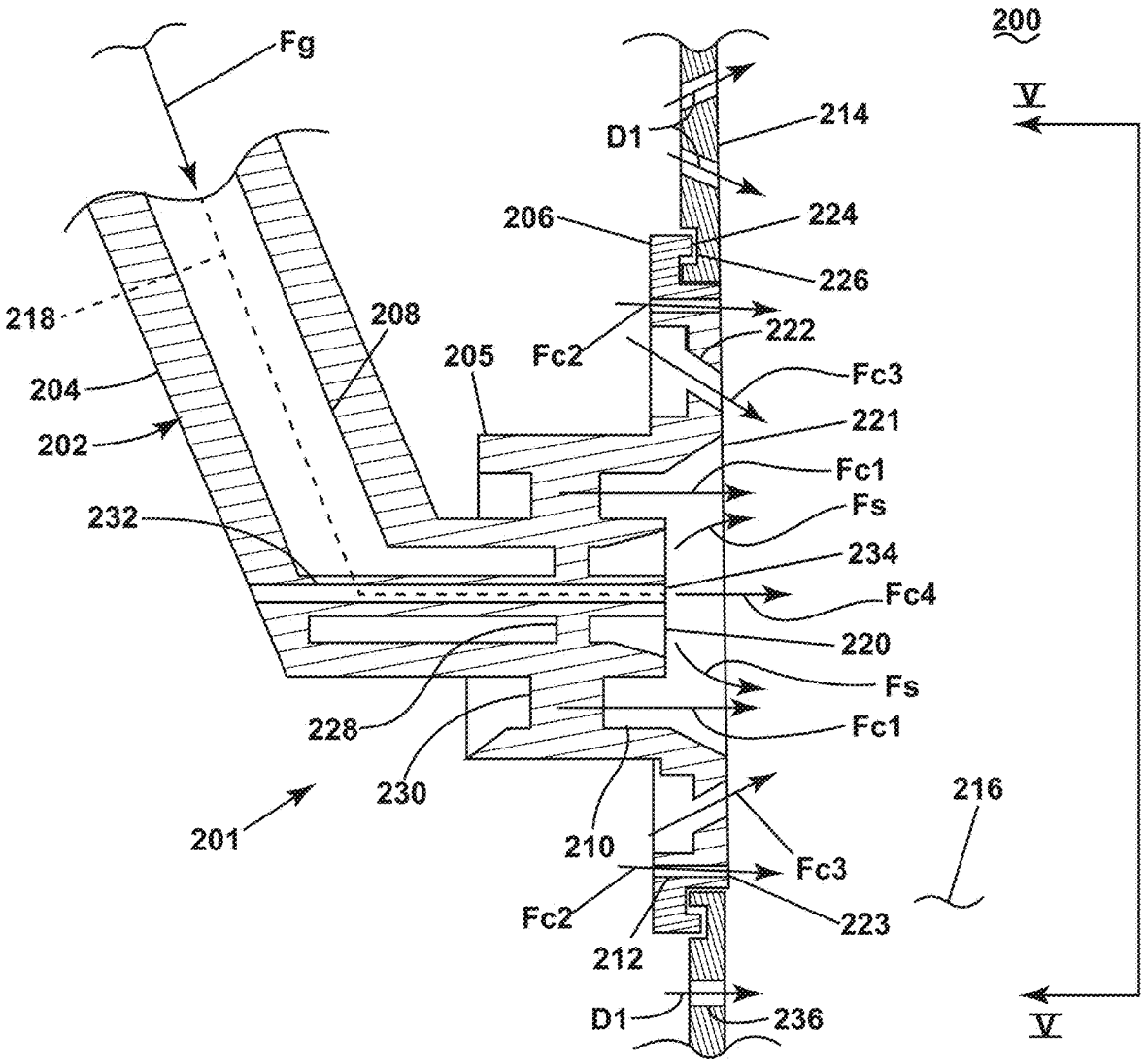
FIG. 4 is a schematic side cross-sectional view of a portion of a combustion section suitable for use as the combustion section of FIG. 1, the combustion section including a fuel nozzle assembly having a fuel nozzle including a first body, the fuel nozzle assembly further comprising a second body and a third body.

FIG. 4 is a schematic side cross-sectional view of a portion of a combustion section 200 suitable for use as the combustion section 14 of FIG. 1. The combustion section 200 is similar to the combustion section 14; therefore, like parts will be identified with like names, with it being understood that the description of the combustion section 14 applies to the combustion section 200 unless noted otherwise.

The combustion section 200 includes a dome wall 214 at least partially defining a combustion chamber 216. The combustion chamber 216, like the combustion chamber 46 (FIG. 3), is further defined by a combustor liner (not illustrated) (e.g., the inner combustor liner 42 and the outer combustor liner 40 of FIG. 3). The combustion section 200 includes a fuel nozzle assembly 201, like the set of fuel nozzles 32 (FIG. 2), that is provided through a fuel nozzle opening provided along the dome wall 214. The fuel nozzle assembly 201 includes a fuel nozzle 202 having a first body 204, a second body 205, and a third body 206. The first body 204 and the second body 205 can be integrally formed.

The first body 204 defines a centerline axis 218. The first body 204 defines a gaseous fuel channel 208. The gaseous fuel channel 208 exhausts into the combustion chamber 216 at a gaseous fuel outlet 220. At least a portion of the second body 205 is radially spaced, with respect to the centerline axis 218, from the first body 204 to define a first compressed air channel 210 provided therebetween. The first compressed air channel 210 exhausts into the combustion chamber 216 at a first outlet 221. At least a portion of the third body 206 is radially spaced, with respect to the centerline axis 218, from the second body 205 to define a second compressed air channel 212 therebetween. The second compressed air channel 212 exhausts into the combustion chamber 216 at a second outlet 223.

The first body 204 can further define a third compressed air channel 232. The third compressed air channel 232 exhausts into the combustion chamber 216 at a third outlet 234. The third compressed air channel 232 can extend axially with respect to a portion of the centerline axis 218. The third compressed air channel 232 can extend along a respective portion of the centerline axis 218. While shown as being integrally formed with the first body 204, it will be appreciated that the third compressed air channel 232 can be defined by a fourth body (not illustrated) that extends through the gaseous fuel channel 208. The fuel nozzle assembly 201 can be separate from the dome wall 214. In other words, the fuel nozzle assembly 201 can be coupled to, but not integrally formed with, the dome wall 214. Alternatively, the fuel nozzle assembly 201 can be integrally formed within the dome wall 214.

The gaseous fuel channel 208, the first compressed air channel 210, the second compressed air channel 212 and the third compressed air channel 232 can extend any suitable distance or have any suitable cross-sectional area when viewed along a plane extending along the centerline axis 218. As a non-limiting example, at least two of the gaseous fuel outlet 220, the first outlet 221, the second outlet 223, the third outlet 234, or a combination thereof, can be axially aligned or offset from each other.

A first swirler 228 is provided within the gaseous fuel channel 208. A second swirler 230 is provided within the first compressed air channel 210. The first swirler 228 and the second swirler 230 are any suitable component that is configured to impart a swirling motion to a flow of fluid from an upstream edge of the swirler to a downstream edge of the swirler such that the flow of fluid includes a helical or otherwise swirled flow downstream of the swirler. As a non-limiting example, the first swirler 228 and the second swirler 230 can each be formed as a plurality of airfoils circumferentially spaced within the gaseous fuel channel 208 and the first compressed air channel 210, respectively. The amount of swirl to the flow of fluid that flows over or through the first swirler 228 and the second swirler 230 can be quantified by a swirl number defined as an integral of the tangential momentum to the axial momentum of the flow of fluid downstream of a respective swirler. The first swirler 228 and the second swirler 230 are defined as swirlers that create a swirled airflow having a swirl number of greater than or equal to 0.2 and less than or equal to 1.2.

The second swirler 230 operably couples the first body 204 and the second body 205. The first swirler 228 and the second swirler 230 can be integrally formed with the first body 204, such that the first body 204 forms a unitary body with the first swirler 228, the second swirler 230 or a combination thereof. The second swirler 230 can be integrally formed with the second body 205 such that the second body 205 forms a unitary body with the second swirler 230. The first swirler 228, the second swirler 230, the first body 204 and the second body 205 can be integrally formed such that the first swirler 228, the second swirler 230, the first body 204 and the second body 205 are formed as a unitary body.

A first set of flame shaping holes 222 can be provided within the second body 205. The first set of flame shaping holes 222 exhaust to the combustion chamber 216. Each flame shaping passage of the first set of flame shaping holes 222 can extend, from left to right of the page, radially toward, radially away from, or parallel with the centerline axis 218. The first set of flame shaping holes 222 fluidly couples compressed air from the compressor (e.g., the compressor 12 of FIG. 1) to the combustion chamber 216. The compressed air passing through the first set of flame shaping holes 222 is used to shape the flame and/or provide additional air to aid in more complete combustion, as well as increase the mass flow rate in the working fluid flow.

The third body 206 is coupled to the dome wall 214. The third body 206 can include an annular arm 224 that extends continuously about an entirety of the centerline axis 218. Alternatively, the annular arm 224 can be segmented or otherwise extend about less than an entirety of the centerline axis 218. The dome wall 214 can include an annular groove 226 that extends continuously about an entirety of the centerline axis 218. Alternatively, the annular groove 226 can be segmented or otherwise extend about less than an entirety of the centerline axis 218. As a non-limiting example, the annular arm 224 can fit within the annular groove 226 such that a lap joint is formed between the third body 206 and the dome wall 214. The annular arm 224 and the annular groove 226 are sized to permit radially movement of the annular arm 224 within the annular groove 226. As such, the third body 206 is free to move radially within the annular groove 226 such that the fuel nozzle assembly 201 can move radially with respect to the centerline axis 218 during operation of the fuel nozzle assembly 201.

The third body 206 can be defined as a moveable annular ferrule that sealingly couples the fuel nozzle assembly 201 to the dome wall 214. In other words, the third body 206 is sealingly coupled to the dome wall 214 such that a fluid cannot pass between an interface between the dome wall 214 and the third body 206. The third body 206 is further used to align the fuel nozzle assembly 201 within the fuel nozzle opening along the dome wall 214. As a non-limiting example, during assembly, the third body 206 is coupled to the dome wall 214, and the fuel nozzle 202 is subsequently inserted into the fuel nozzle opening such that the fuel nozzle 202 is circumscribed by the third body 206.

The dome wall 214 can include a second set of flame shaping holes 236. The second set of flame shaping holes 236 are provided radially outward from the first set of flame shaping holes 222. The second set of flame shaping holes 236 exhaust to the combustion chamber 216. Each flame shaping hole of the second set of flame shaping holes 236 can extend, from left to right of the page, radially toward, radially away from, or parallel with the centerline axis 218.

The combustion section 200 can include any number of one or more fuel nozzle assemblies 201. Each fuel nozzle assembly 201 is defined by a portion of the combustion section 200 extending through a respective singular portion of the dome wall 214 (e.g., a respective fuel nozzle opening) and having a single gaseous fuel supply.

During operation, a flow of gaseous fuel (Fg) is fed to the gaseous fuel channel 208. The flow of gaseous fuel (Fg) flows through the gaseous fuel channel 208 and over the first swirler 228 to define a swirled flow of gaseous fuel (Fs) that is exhausted into the combustion chamber 216. The swirled flow of gaseous fuel (Fs) can be ignited within the combustion chamber 216 through an igniter (not illustrated) or by auto-ignition. The flow of gaseous fuel (Fg) can contain 100% hydrogen ("H2") fuel or a mixture of hydrogen fuel and another gaseous fuel (e.g., methane). Alternatively, the flow of gaseous fuel (Fg) can be a mixture of H2 fuel and compressed air from, for example, the compressor section (e.g., the compressor section 12 of FIG. 1).

A flow of compressed air (e.g., the compressed air (C) of FIG. 3) is fed to various portions of the fuel nozzle assembly 201. As a non-limiting example, a first flow of compressed air (Fc1) is fed to and through the first compressed air channel 210, a second flow of compressed air (Fc2) is fed to and through the second compressed air channel 212, a third flow of compressed air (Fc3) is fed to and through the first set of flame shaping holes 222, and a fourth flow of compressed air (Fc4) is fed to and through the third compressed air channel 232. As the first set of flame shaping holes 222 can include the third flow of compressed air (Fc3), the first set of flame shaping holes 222 can be defined as a third air channel. As the third compressed air channel 232 can include the fourth flow of compressed air (Fc4), the third compressed air channel 232 be defined as a fourth air channel.

The first flow of compressed air (Fc1), the second flow of compressed air (Fc2), the third flow of compressed air (Fc2), the fourth flow of compressed air (Fc4), or a combination thereof, can be from the same or different sources of compressed air. As a non-limiting example, the first flow of compressed air (Fc1) can be from the HP compressor (e.g., the HP compressor 24 of FIG. 1), while the second flow of compressed air (Fc2) can be from the LP compressor (e.g., the LP compressor 22 of FIG. 1). As a non-limiting example, each of the first flow of compressed air (Fc1), the second flow of compressed air (Fc2), the third flow of compressed air (Fc2), and the fourth flow of compressed air (Fc4) can each be a flow of compressed air from the compressor section (e.g., the compressor 12 of FIG. 1). While described in terms of a flow of compressed air, it will be appreciated that one or more of the first flow of compressed air (Fc1), the second flow of compressed air (Fc2), the third flow of compressed air (Fc2), or the fourth flow of compressed air (Fc4) can include a gaseous fuel within the respective flow of compressed air.

A flame shaping airflow (D1), defined by a compressed airflow similar to the first flame shaping airflow (D1) of FIG. 3, can be fed to the combustion chamber 216 through the second set of flame shaping holes 236. The flame shaping airflow (D1) can be provided radially outward from the first flow of compressed air (Fc1), the second flow of compressed air (Fc2), the third flow of compressed air (Fc2), and the fourth flow of compressed air (Fc4). The flame shaping airflow (D1), like the first flow of compressed air (Fc1), the second flow of compressed air (Fc2), the third flow of compressed air (Fc2), and the fourth flow of compressed air (Fc4), can be a compressed airflow from a portion of the turbine engine 10 upstream of the combustion chamber 216.

The first flow of compressed air (Fc1), the second flow of compressed air (Fc2), the third flow of compressed air (Fc2), the fourth flow of compressed air (Fc4), the flame shaping airflow (D1), or a combination thereof, are used to shape the flame (e.g., provide a desired footprint of the physical flame within the combustion chamber 216), and insulate various portions of the combustion section 200 from the flame. The flame shaping is done by forming an annular curtain of compressed air around the flame. As a non-limiting example, the first flow of compressed air (Fc1), the second flow of compressed air (Fc2), the third flow of compressed air (Fc3), the flame shaping airflow (D1), or a combination thereof, can form an annular curtain of air that are used to shape the flame in a desired fashion and provide a layer of insulation between the flame and various portions of the combustion section 200. The fourth flow of compressed air (Fc4) is used to push the flame aft of the fuel nozzle assembly 201 and dome wall 214. At least one of the first flow of compressed air (Fc1), the second flow of compressed air (Fc2), the third flow of compressed air (Fc3), the flame shaping airflow (D1), or a combination thereof, can be used to swirl the flame similar to how the first swirler 228 and the second swirler 230 are used.

It will be appreciated that the combustion section 200 can include any number of one or more sets of flame shaping holes or channels configured to provide a footprint of the flame generated through ignition of a flow of gaseous fuel (Fg) from the gaseous fuel channel 208. The combustion section 200 can include a set of flame shaping holes provided along the dome wall (e.g., the second set of flame shaping holes 236), the second body 205 (e.g., the first set of flame shaping holes 222), the third body 206 (e.g., the second compressed air channel 212), or a combination thereof.

While not illustrated, the combustion section 200 can include a controller module communicatively coupled to a set of valves in order to automatically control a flow of fluids to or within respective portions of the combustion section 200. As a non-limiting example, the controller module can automatically control a supply of the flow of gaseous fuel (Fg) to the gaseous fuel channel 208. As a non-limiting example, the controller module can automatically control a supply of the first flow of compressed air (Fc1) to the first compressed air channel 210. As a non-limiting example, the controller module can automatically control a supply of the second flow of compressed air (Fc2) to the second compressed air channel 212. As a non-limiting example, the controller module can automatically control a supply of the third flow of compressed air (Fc3) to the first set of flame shaping holes 222. As a non-limiting example, the controller module can automatically control a supply of the fourth flow of compressed air (Fc4) to the third compressed air channel 232. As a non-limiting example, the controller module can automatically control a supply of the flame shaping airflow (D1) to at least a portion of the flame shaping holes of the second set of flame shaping holes 236. The flow of gaseous fuel (Fg), the first flow of compressed air (Fc1), the second flow of compressed air (Fc2), the third flow of compressed air (Fc2), and the fourth flow of compressed air (Fc4) can be controlled independently of one another. As a non-limiting example, a flow of compressed air can be shut off to the first set of flame shaping holes 222 but be sent to the first compressed air channel 210.

The shaping of the flame and insulation between the flame and other portions of the combustion section 200 is especially important when utilizing a gaseous H2 fuel in comparison with traditional fuels. The gaseous H2 fuel has a higher burn temperature and tendency for flashback compared to the traditional fuels. As such, at least one of the first flow of compressed air (Fc1), the second flow of compressed air (Fc2), the third flow of compressed air (Fc2), the fourth flow of compressed air (Fc4), or a combination thereof is used to push the flame away from the fuel nozzle 202. The pushing of the swirled flow of fuel (Fs) away from the fuel nozzle assembly 201 helps ensure that flashback into the fuel nozzle 202 of the swirled flow of fuel (Fs), once ignited, does not occur. At least one of the first flow of compressed air (Fc1), the second flow of compressed air (Fc2), the third flow of compressed air (Fc2), the fourth flow of compressed air (Fc4), or a combination thereof further ensures that the flame, which burns hotter than a flame generated from the traditional fuels, does not overly heat sections of the combustion section 200. At least one of the first flow of compressed air (Fc1), the second flow of compressed air (Fc2), the third flow of compressed air (Fc2), the fourth flow of compressed air (Fc4), or a combination thereof can further be used to create a uniform flame distribution at the combustor outlet. It is contemplated that a uniform flame distribution or temperature distribution at the combustor outlet results in a higher efficiency of the turbine section.

Figure 5:
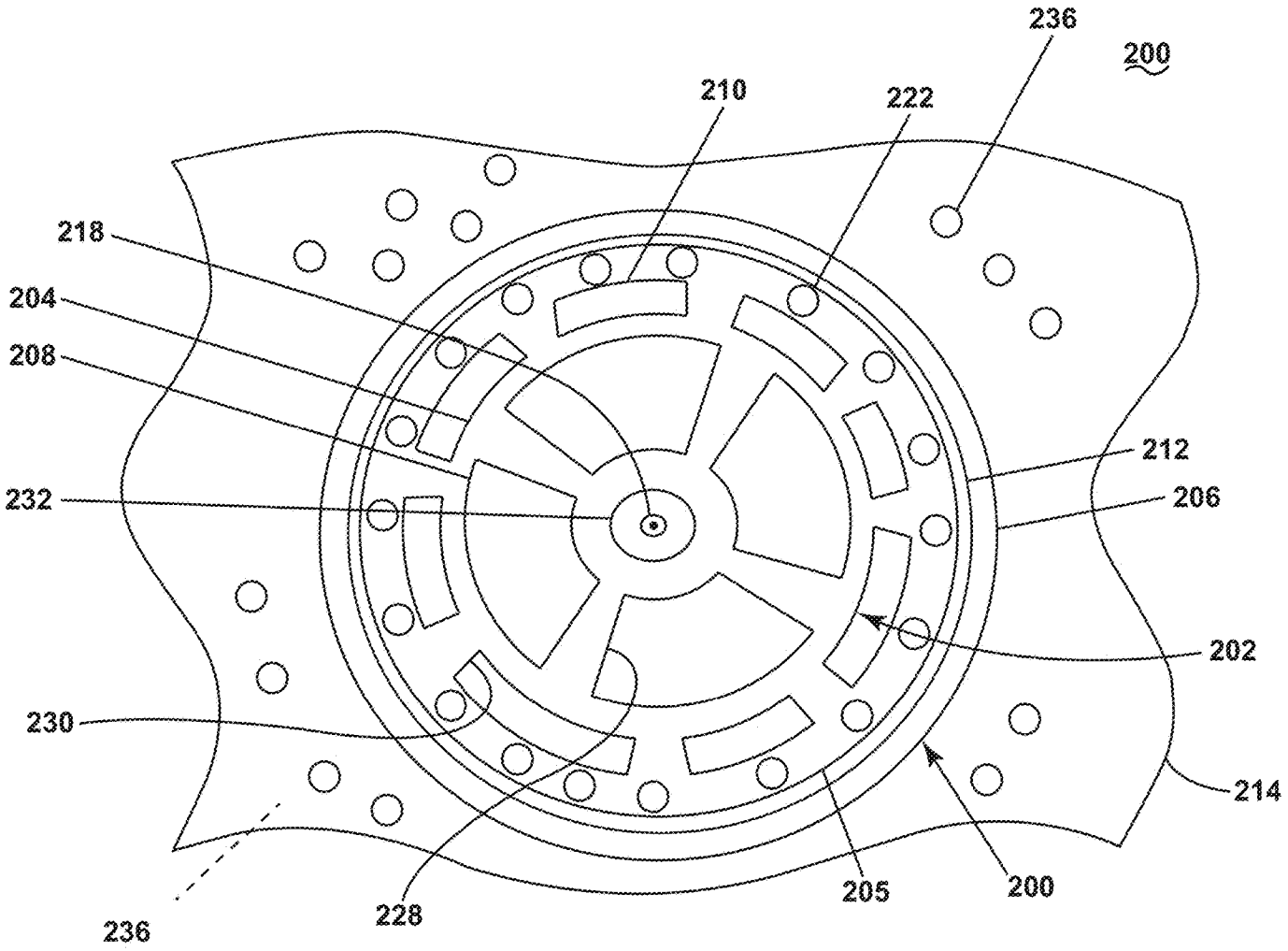
FIG. 5 is a schematic view of the combustion section viewed from sight line V-V of FIG. 4, further illustrating the first body, the second body, and the third body.

FIG. 5 is a schematic view of the fuel nozzle 202 as viewed along sight line V-V of FIG. 4. The gaseous fuel channel 208, the first compressed air channel 210 the second compressed air channel 212, and the third compressed air channel 232 are each formed as annular grooves. The second compressed air channel 212 circumscribes the first compressed air channel 210. The first compressed air channel 210 circumscribes the gaseous fuel channel 208. The gaseous fuel channel 208 circumscribes the third compressed air channel 232.

The gaseous fuel channel 208, the first compressed air channel 210 the second compressed air channel 212, and the third compressed air channel 232 can each extend continuously about an entirety of the centerline axis 218. Alternatively, The gaseous fuel channel 208, the first compressed air channel 210 the second compressed air channel 212, the third compressed air channel 232, or a combination thereof can be segmented, non-continuous or otherwise extend about less than an entirety of the centerline axis 218. As a non-limiting example, the second compressed air channel 212 can be segmented such that the second body 205 can be integrally formed with the third body 206.

The first set of flame shaping holes 222 and the second set of flame shaping holes 236 can be formed as discrete holes or channels provided along the second body 205. The second set of flame shaping holes 236 can be provided along any suitable portion of the dome wall 214. The second flame shaping holes of the second set of flame shaping holes 236 can be circumferentially spaced, radially spaced, or a combination thereof from one another. The first set of flame shaping holes 222, the second set of flame shaping holes 236, or combination thereof can be evenly or non-evenly spaced about the centerline axis 218. It will be appreciated that the first set of flame shaping holes 222 can be used in place of or in conjunction with the second set of flame shaping holes 236, or vice-versa.

It will be appreciated that each compressed air passage (e.g., the second compressed air channel 212, the first set of flame shaping holes 222, the second set of flame shaping holes 236, and the third compressed air channel 232) are defined by a percentage of a total volume of compressed air that is fed to the combustion chamber 216. As a non-limiting example, greater than or equal to 10% and less than or equal to 30% of the total volume of compressed air that is fed to the combustion chamber 216 can be fed through the first compressed air channel 210 (e.g., the first flow of compressed air (Fc1) of FIG. 4). As a non-limiting example, greater than or equal to 5% and less than or equal to 25% of the total volume of compressed air that is fed to the combustion chamber 216 can be fed through the second compressed air channel 212 (e.g., the second flow of compressed air (Fc2) of FIG. 4), through the first set of flame shaping holes 222 (e.g., the third flow of compressed air (Fc3) of FIG. 4), through the outside set of flame shaping holes 236, or a combination thereof. As a non-limiting example, greater than or equal to 0.1% and less than or equal to 2% of the total volume of compressed air that is fed to the combustion chamber 216 can be fed through the third compressed air channel 232 (e.g., the fourth flow of compressed air (Fc4) of FIG. 4).

Figure 6:
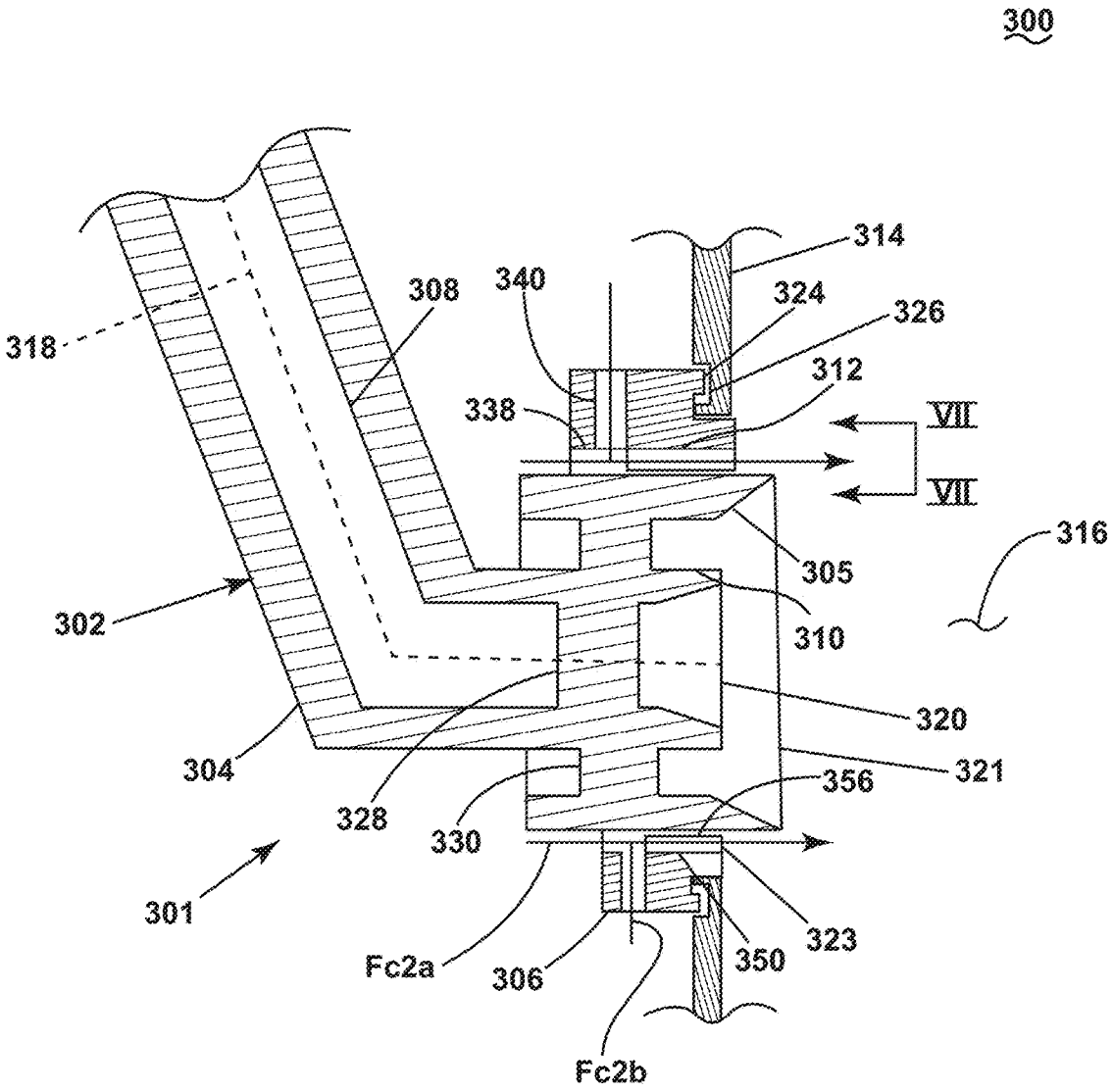
FIG. 6 is a schematic side cross-sectional view of an exemplary combustion section suitable for use as the combustion section of FIG. 1, the combustion section including a fuel nozzle assembly having a first body, a second body, a third body, a gaseous fuel channel defined by the first body, a first compressed air channel defined between the first body and the second body, and a second compressed air channel defined between the second body and the third body.

FIG. 6 is a schematic side cross-sectional view of an exemplary combustion section 300 suitable for use as the combustion section 200 of FIG. 1. The combustion section 300 is similar to the combustion section 200 (FIG. 4), therefore, like parts will be identified with like numerals increased to the 300 series with it being understood that the description of the combustion section 200 applies to the combustion section 300 unless noted otherwise.

The combustion section 300 includes a fuel nozzle assembly 301, a dome wall 314 and a combustion chamber 316. The fuel nozzle assembly 301 includes a fuel nozzle 302 having a first body 304 defining a centerline axis 318. The first body 304 defines a gaseous fuel channel 308. The gaseous fuel channel 308 exhausts into the combustion chamber 316 at a gaseous fuel outlet 320. The fuel nozzle assembly 301 further includes a second body 305 and a third body 306. A first compressed air channel 310 exhausting into the combustion chamber 316 at a first outlet 321 is at least partially defined between the first body 304 and the second body 305. A second compressed air channel 312 exhausting into the combustion chamber 316 at a second outlet 323 is at least partially defined between the second body 305 and the third body 306. The third body 306 can include an annular arm 324. The dome wall 314 can include an annular groove 326. A first swirler 328 is provided within the gaseous fuel channel 308. A second swirler 330 is provided within the first compressed air channel 310. The first body 304, the second body 305, the third body 306, the first swirler 328 and the second swirler 330 can be integrally formed such that the first body 304, the second body 305, the third body 306, the first swirler 328 and the second swirler 330 form a unitary body. A first set of flame shaping holes (not illustrated) can be provided along the fuel nozzle assembly 301, the dome wall 314, or a combination thereof. While not illustrated, a first set of flame shaping holes (e.g., the second set of flame shaping holes 236 FIG. 4) can be provided along the dome wall 314.

The fuel nozzle assembly 301 is similar to the fuel nozzle assembly 201 (FIG. 4), except that the fuel nozzle assembly 301 does not include the third compressed air channel 232 (FIG. 4). The second compressed air channel 312 further includes a first leg 338 and a second leg 340, non-parallel to the first leg 338, that merge together at the second compressed air channel 312. The first leg 338 can be formed between the third body 306 and the second body 305. Alternately, the first leg 338 can be formed within one of the third body 306 or the second body 305. The second leg 340 can be formed within the third body 306. The first leg 338 can extend axially, while the second leg 340 can extend radially. The second compressed air channel 312 is at least partially defined by a scalloped section 350 that terminates within the second compressed air channel 312 at an inner surface 356. While only two legs are illustrated, it will be appreciated that the second compressed air channel 312 can include any number of legs. As a non-limiting example, a third leg and a fourth leg can branch off from the second compressed air channel 312 and exhaust into the combustion chamber 316 at respective portions of the second outlet 323. It will be further appreciated that any channel described herein (e.g., the gaseous fuel channel 308, the first compressed air channel 310, etc.) can include any number of legs.

The first body 304 and the second body 305 can be integrally formed to define a unitary body, similar to the first body 204 and the second body 205 of FIG. 4. The third body 306 can be integrally or non-integrally formed with the unitary body of the first body 304 and the second body 305. As a non-limiting example, the unitary body of the first body 304 and the second body 305 can be non-integrally formed with the third body 306 such that the third body 306 is first coupled to the dome wall 314, or otherwise integrally formed with the dome wall 314, and the unitary body of the first body 304 and the second body 305 is subsequently inserted into the third body 306.

During operation, a first third body flow of compressed air (Fc2*a*) can be fed to or selectively fed to (e.g., through use of a controller module and valve(s)) to the first leg 338. A second third body flow of compressed air (Fc2*b*) can be fed to or selectively fed to (e.g., through use of a controller module and valve(s)) to the second leg 340. The first third body flow of compressed air (Fc2*a*), the second third body flow of compressed air (Fc2*b*), or a combination thereof are fed to the second compressed air channel 312 to define the third flow of compressed air (e.g., the third flow of compressed air (Fc3) of FIG. 4). The first third body flow of compressed air (Fc2*a*) and the second third body flow of compressed air (Fc2*b*) can be from the same or differing sources of compressed air. The inclusion of both the first leg 338 and the second leg 340 rather than just a single leg (e.g., like the fuel nozzle assembly 201) ensures that a volume of compressed air being fed to the combustion chamber 316 is adequate to provide for the desired flame shaping and insulative properties as described herein. It is contemplated that the first leg 338, the second leg 340 and the scalloped section 350 can be formed to ensure that the total volume of air that is fed to the combustion chamber 316 through the second compressed air channel 312 is greater than or equal to 5% and less than or equal to 25% of a total volume of compressed air that is fed to the combustion chamber 316. The volume of compressed air fed through the compressed air channels 312 falls within the aforementioned range ensures that the volume of compressed air being fed through the compressed air channels 312 is sufficient to provide a desired flame shaping and insulative property.

Figure 7:
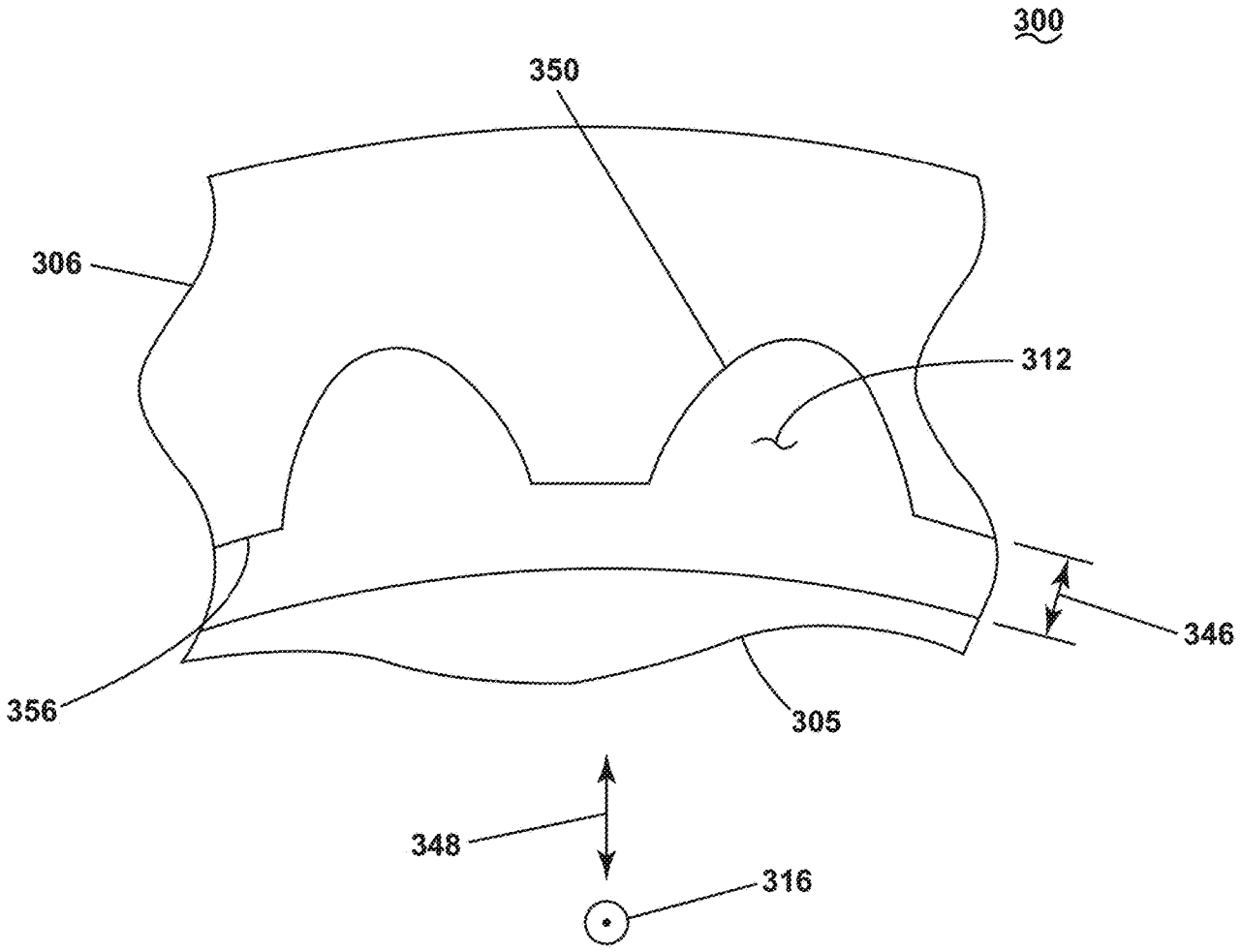
FIG. 7 is a schematic view of the fuel nozzle assembly viewed from sight line VII-VII of FIG. 6, further illustrating the second compressed air channel including a scalloped section.

FIG. 7 is a schematic view of a portion of the fuel nozzle assembly 301 as seen from sight line VII-VII of FIG. 6. The scalloped section 350 of the second compressed air channel 312 is defined by a series of circumferentially spaced cutouts within the third body 306. A gap 346 can be provided between the inner surface 356 of the scalloped section 350 and the second body 305.

During operation, the fuel nozzle assembly 301, specifically the second body 305, can move radially inward and outward as denoted by arrow 348. As such, a size of the gap 346 can change as the second body 305 moves. In some instances, the second body 305 can come into contact with the third body 306 such that a respective portion of the gap 346 is zero. The scalloped section 350 ensures that a flow of compressed fluid (the third flow of compressed fluid (Fc3) of FIG. 6) continues to flow through the second compressed air channel 312, specifically the scalloped section 350 of the second compressed air channel 312, even when the gap 346 is zero. This, in turn, ensures that the annular curtain of air will always be formed around the flame even when the gap 346 is zero.

It will be appreciated that the second compressed air channel 312 is used as a flame shaping channel, similar to the first set of flame shaping holes 222 (FIG. 4) and the second set of flame shaping holes 236 (FIG. 3). The scalloped section 350 ensures that a portion of the second compressed air channel 312 is always open. In other words, the third flow of compressed air (Fc3) can always flow through the scalloped section 350 such that the scalloped section 350 defines a series of flame shaping holes provided along the fuel nozzle assembly 301 and formed within the third body 306.

Figure 8:
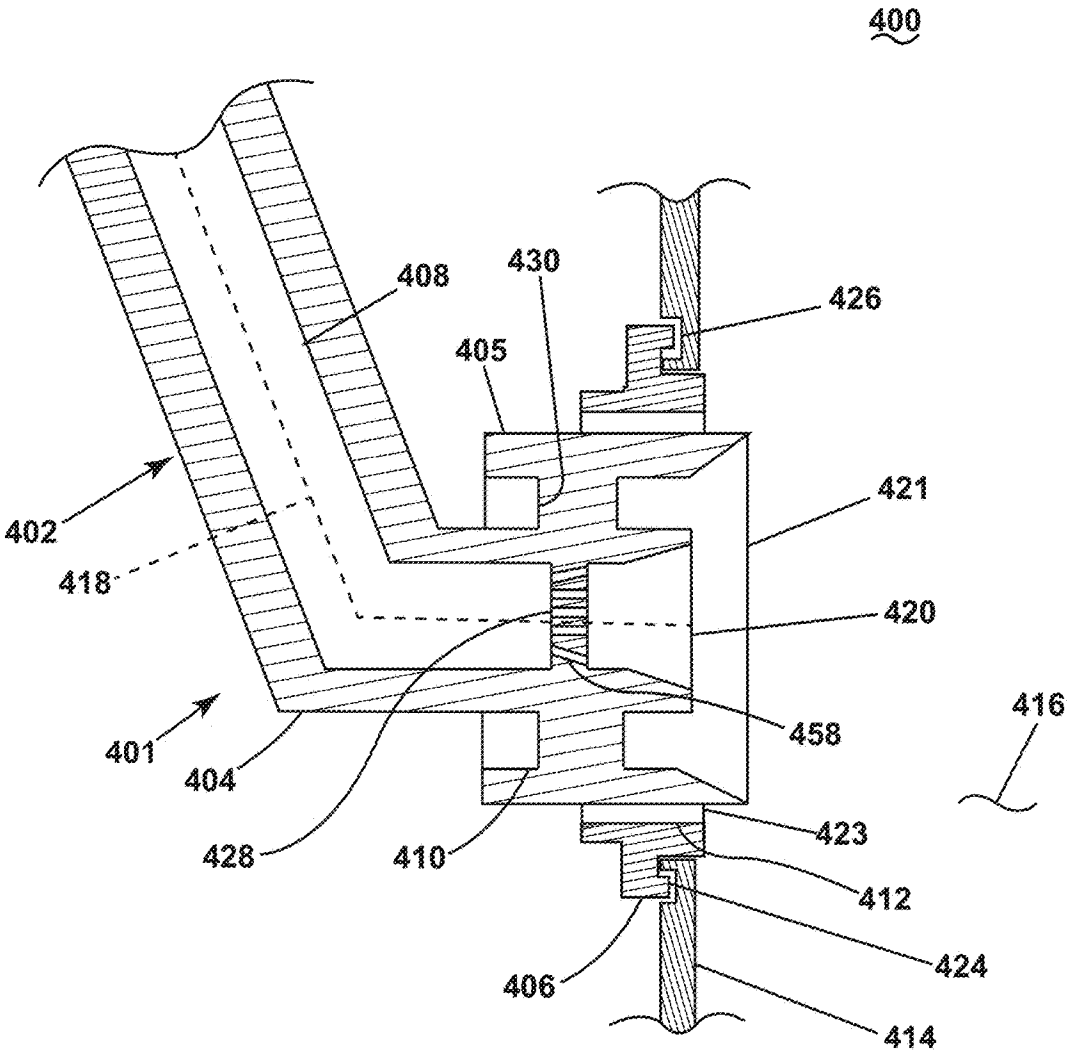
FIG. 8 is a schematic side cross-sectional view of an exemplary combustion section suitable for use as the combustion section of FIG. 1, the combustion section including a fuel nozzle assembly having a first body, a second body, and a third body, the first body defining a gaseous fuel channel, with an orifice plate provided within the gaseous fuel channel.

FIG. 8 is a schematic side cross-sectional view of an exemplary combustion section 400 suitable for use as the combustion section 200 of FIG. 1. The combustion section 400 is similar to the combustion section 200 (FIG. 4), 300 (FIG. 6), therefore, like parts will be identified with like numerals increased to the 400 series with it being understood that the description of the combustion section 200, 300 applies to the combustion section 400 unless noted otherwise.

The combustion section 400 includes a fuel nozzle assembly 401, a dome wall 414 and a combustion chamber 416. The fuel nozzle assembly 401 includes a fuel nozzle 402 having a first body 404 defining a centerline axis 418. The first body 404 defines a gaseous fuel channel 408. The gaseous fuel channel 408 exhausts into the combustion chamber 416 at a gaseous fuel outlet 420. The fuel nozzle assembly 401 further includes a second body 405 and a third body 406. A first compressed air channel 410 exhausting into the combustion chamber 416 at a first outlet 421 is at least partially defined between the first body 404 and the second body 405. A second compressed air channel 412 exhausting into the combustion chamber 416 at a second outlet 423 is at least partially defined between the second body 405 and the third body 406. The third body 406 can include an annular arm 424. The dome wall 414 can include an annular groove 426. A first swirler 428 is provided within the gaseous fuel channel 408. A second swirler 430 is provided within the first compressed air channel 410. The first body 404, the second body 405, the third body 406, the first swirler 428 and the second swirler 430 can be integrally formed such that the first body 404, the second body 405, the third body 406, the first swirler 428 and the second swirler 430 form a unitary body. A first set of flame shaping holes (not illustrated) can be provided along the fuel nozzle assembly 401, the dome wall 414, or a combination thereof. While not illustrated, a first set of flame shaping holes (e.g., the second set of flame shaping holes 236 FIG. 4) can be provided along the dome wall 414.

The fuel nozzle assembly 401 is similar to the fuel nozzle assembly 201 (FIG. 4), 301 (FIG. 6) in that it includes the first swirler 428 within the gaseous fuel channel 408. The first swirler 428, however, can instead be formed as an orifice plate including a plurality of orifices 458 as opposed to a set of circumferentially spaced airfoils. The plurality of orifices 458 can be oriented such that the plurality of orifices 458 provide the swirling effect that the first swirler 228 (FIG. 4), 328 (FIG. 6) provides. The first swirler 428 is formed as a wall extending radially and circumferentially through an entirety of a respective portion of the gaseous fuel channel 408. It will be appreciated that either or both of the first swirler 428 or the second swirler 430 can be formed as an orifice plate.

Figure 9:
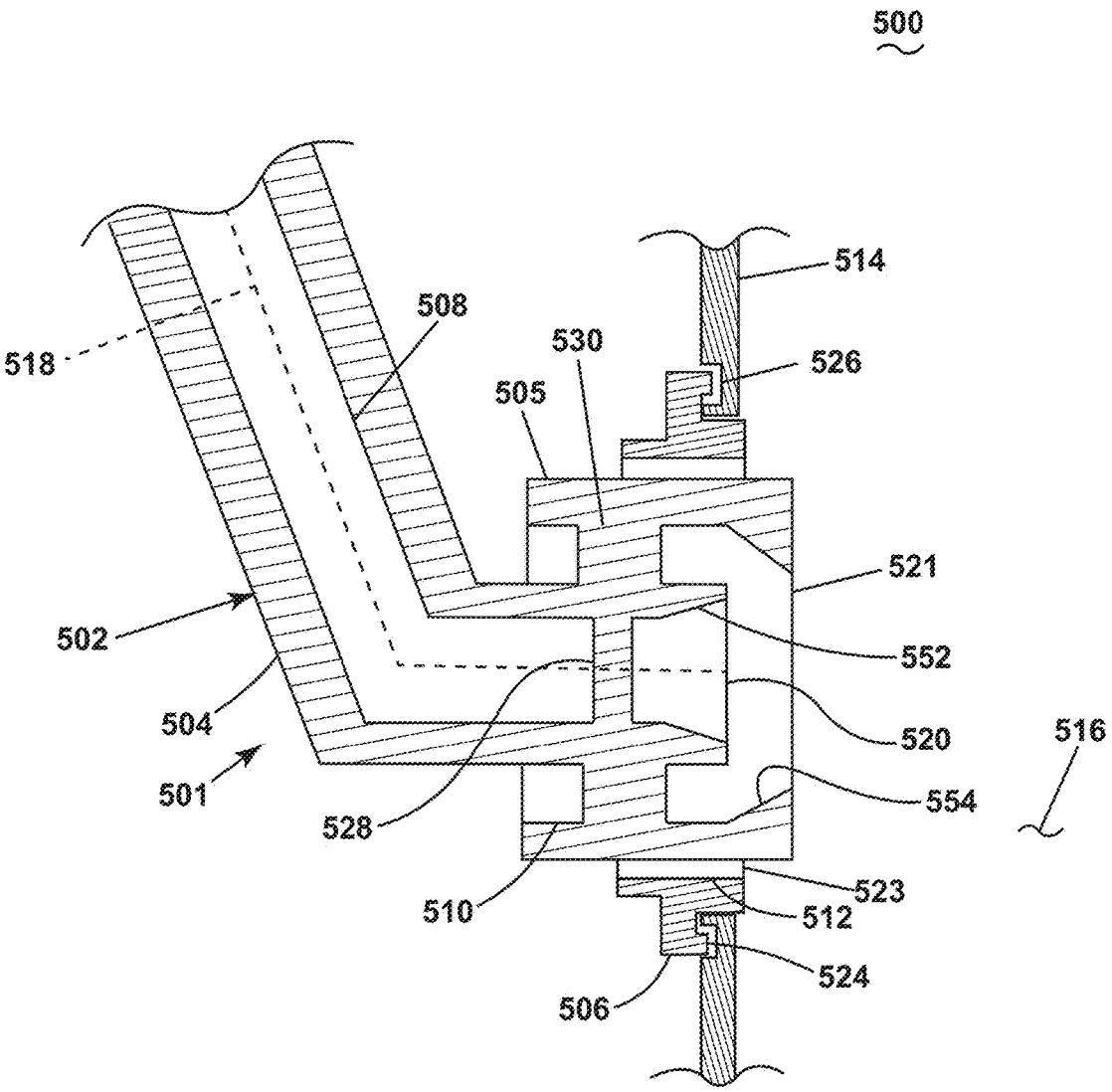
FIG. 9 is a schematic side cross-sectional view of an exemplary combustion section suitable for use as the combustion section of FIG. 1, the combustion section including a fuel nozzle assembly having a first body, a second body, and a third body, the first body including a first angled section, and the second body including a second angled section opposing the first angled section.

FIG. 9 is a schematic side cross-sectional view of an exemplary combustion section 500 suitable for use as the combustion section 200 of FIG. 1. The combustion section 500 is similar to the combustion section 200 (FIG. 5), 300 (FIG. 6), 400 (FIG. 8), therefore, like parts will be identified with like numerals increased to the 500 series with it being understood that the description of the combustion section 200, 300, 400 applies to the combustion section 500 unless noted otherwise.

The combustion section 500 includes a fuel nozzle assembly 501, a dome wall 514 and a combustion chamber 516. The fuel nozzle assembly 501 includes a fuel nozzle 502 having a first body 504 defining a centerline axis 518. The first body 504 defines a gaseous fuel channel 508. The gaseous fuel channel 508 exhausts into the combustion chamber 516 at a gaseous fuel outlet 520. The fuel nozzle assembly 501 includes a second body 505 and a third body 506. A first compressed air channel 510 exhausting into the combustion chamber 516 at a first outlet 521 is at least partially defined between the first body 504 and the second body 505. A second compressed air channel 512 exhausting into the combustion chamber 516 at a second outlet 523 is at least partially defined between the second body 505 and the third body 506. The third body 506 can include an annular arm 524. The dome wall 514 can include an annular groove 526. A first swirler 528 is provided within the gaseous fuel channel 508. A second swirler 530 is provided within the first compressed air channel 510. The first body 504, the second body 505, the third body 506, the first swirler 528 and the second swirler 530 can be integrally formed such that the first body 504, the second body 505, the third body 506, the first swirler 528 and the second swirler 530 form a unitary body. A first set of flame shaping holes (not illustrated) can be provided along the fuel nozzle assembly 501, the dome wall 514, or a combination thereof. While not illustrated, a first set of flame shaping holes (e.g., the second set of flame shaping holes 236 FIG. 4) can be provided along the dome wall 514.

The fuel nozzle assembly 501 is similar to the fuel nozzle assembly 201 (FIG. 4), 301 (FIG. 6), 401 (FIG. 8) in that it includes the gaseous fuel channel 508, the first compressed air channel 510 and the second compressed air channel 512. The gaseous fuel channel 508 and the first compressed air channel 510 include a first angled section 552 and a second angled section 554, respectively. The first angled section 552 can oppose the second angled section 554. As a non-limiting example, the first angled section 552 can expand radially outward, while the second angled section 554 can constrict radially inward, or vice-versa. The first angled section 552 extends to and terminates at the gaseous fuel outlet 520. The second angled section 554 extends to and terminates at the first outlet 521. Alternatively, at least one of the first angled section 552 or the second angled section 554 can extend towards but terminate axially prior to the gaseous fuel outlet 520 or the first outlet 521, respectively.

During operation, the first angled section 552 expands the fluid (e.g., the swirled flow of gaseous fuel (Fs) of FIG. 4), while the second angled section 554 constricts the flow of fluid (e.g., the first flow of compressed air (Fc1) of FIG. 4). When compared to the fuel nozzle 202 of FIG. 4, the flame coming out of the fuel nozzle 502 will have a smaller footprint than the flame coming out of the fuel nozzle 202 as the second angled section 554 is pushing the flame radially inward through the flow of fluid flowing through the first compressed air channel 510. The benefit of having the first angled section 552 flare radially outward and the second angled section 554 taper radially inward is an increased flow interaction between the compressed air flowing through the first compressed air channel 510 and the gaseous fuel flowing through the gaseous fuel channel 508. The increased flow interaction, in turn, helps ensure that the hottest portions of the flame (e.g., the central portions of the flame) are kept within a central portion of the combustion chamber 516 and away from, for example, the combustor liner, the dome wall 514, or a combination thereof.

Figure 10:
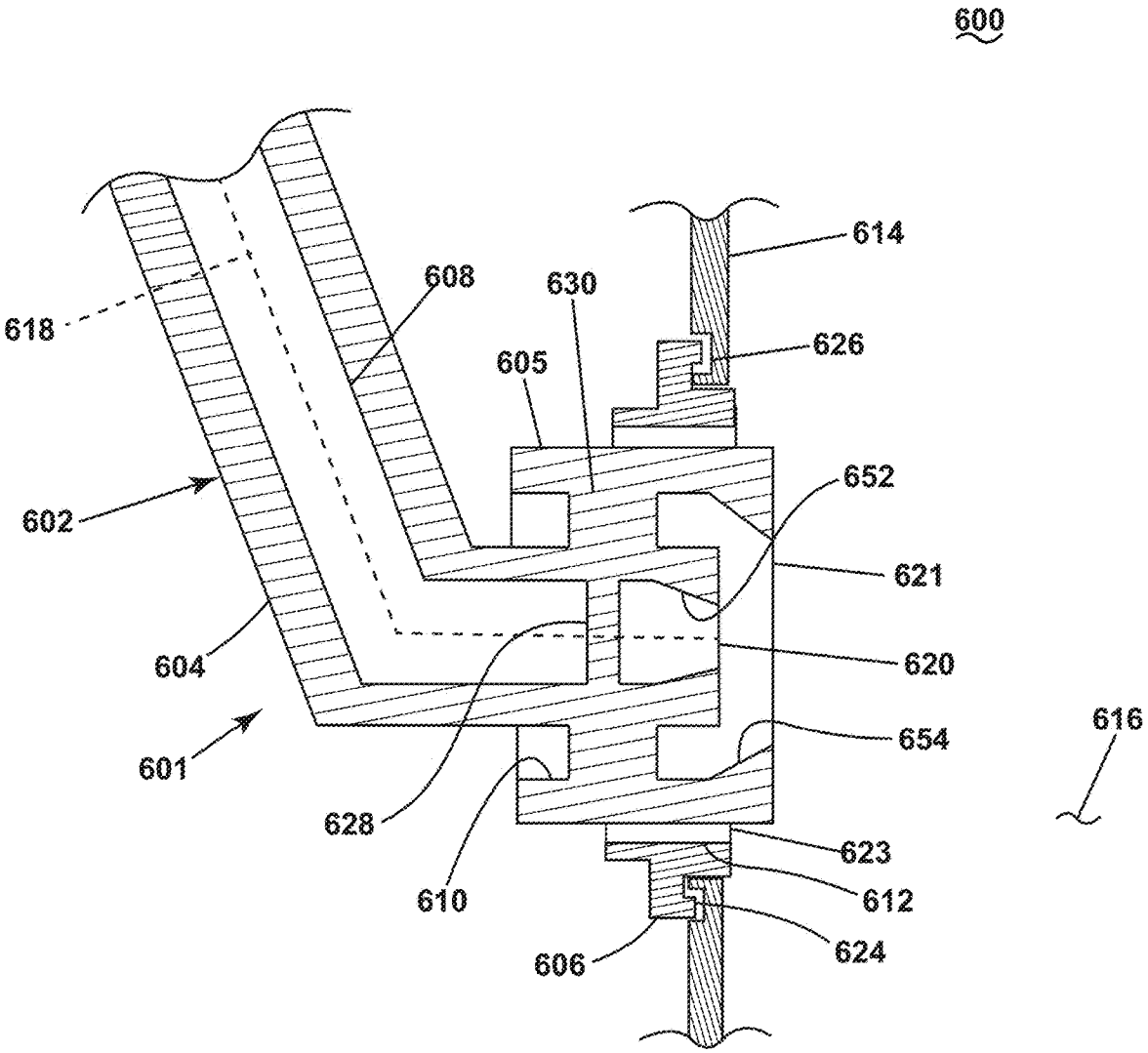
FIG. 10 is a schematic side cross-sectional view of an exemplary combustion section suitable for use as the combustion section of FIG. 1, the combustion section including a fuel nozzle assembly having a first body, a second body, and a third body, the first body including a first angled section, and the second body including a second angled section not opposing the first angled section.

FIG. 10 is a schematic side cross-sectional view of an exemplary combustion section 600 suitable for use as the combustion section 200 of FIG. 1. The combustion section 600 is similar to the combustion section 200 (FIG. 6), 300 (FIG. 6), 400 (FIG. 8), 500 (FIG. 8), therefore, like parts will be identified with like numerals increased to the 600 series with it being understood that the description of the combustion section 200, 300, 400, 500 applies to the combustion section 600 unless noted otherwise.

The combustion section 600 includes a fuel nozzle assembly 601, a dome wall 614 and a combustion chamber 616. The fuel nozzle assembly 601 includes a fuel nozzle 602 having a first body 604 defining a centerline axis 618. The first body 604 defines a gaseous fuel channel 608. The gaseous fuel channel 608 exhausts into the combustion chamber at a gaseous fuel outlet 620. The fuel nozzle assembly 601 includes a second body 605 and a third body 606. A first compressed air channel 610 exhausting into the combustion chamber 616 at a first outlet 621 is at least partially defined between the first body 604 and the second body 605. A second compressed air channel 612 exhausting into the combustion chamber 616 at a second outlet 623 is at least partially defined between the second body 605 and the third body 606. The third body 606 can include an annular arm 624. The dome wall 614 can include an annular groove 626. A first swirler 628 is provided within the gaseous fuel channel 608. A second swirler 630 is provided within the first compressed air channel 610. The first body 604, the second body 605, the third body 606, the first swirler 628 and the second swirler 630 can be integrally formed such that the first body 604, the second body 605, the third body 606, the first swirler 628 and the second swirler 630 form a unitary body. A first set of flame shaping holes (not illustrated) can be provided along the fuel nozzle assembly 601, the dome wall 614, or a combination thereof. While not illustrated, a first set of flame shaping holes (e.g., the second set of flame shaping holes 236 FIG. 4) can be provided along the dome wall 614.

The fuel nozzle assembly 601 is similar to the fuel nozzle assembly 201 (FIG. 4), 301 (FIG. 6), 401 (FIG. 8), 501 (FIG. 9) in that it includes the gaseous fuel channel 608, the first compressed air channel 610 and the second compressed air channel 612. The gaseous fuel channel 608 and the first compressed air channel 610 include a first angled section 652 and a second angled section 654, respectively. The first angled section 652 can be in-line with (e.g., in the same general direction as) the second angled section 654. As a non-limiting example, The first angled section 652 and the second angled section 654 can each extend radially inward. The first angled section 652 can be parallel to or non-parallel to the second angled section 654. The first angled section 652 extends to and terminates at the gaseous fuel outlet 620. The second angled section 654 extends to and terminates at the first outlet 621. Alternatively, at least one of the first angled section 652 or the second angled section 654 can extend towards, but terminate axially prior to, the gaseous fuel outlet 620 or the first outlet 621, respectively. Both of the first angled section 652 and the second angled section 654 can extend radially toward or radially away from the centerline axis 618.

During operation, the first angled section 652 constricts the fluid (e.g., the swirled flow of gaseous fuel (Fs) of FIG. 4). The second angled section 654 constricts the flow of fluid (e.g., the first flow of compressed air (Fc1) of FIG. 4). When compared to the fuel nozzle 502 of FIG. 9, the flame coming out of the fuel nozzle 602 will have a smaller footprint than the flame coming out of the fuel nozzle 502 as both the first angled section 652 and the second angled section 654 are constricting the respective flows of fluid. The benefit of having both the first angled section 652 and the second angled section 654 taper radially inward is that the flame is constricted such that the hottest portions of the flame (e.g., the central portions of the flame) are kept within a central portion of the combustion chamber 516 and away from, for example, the combustor liner, the dome wall 614, or a combination thereof.

Benefits of the present disclosure include a combustor suitable for use with a gaseous H2 fuel. As outlined previously, gaseous H2 fuels have a higher flame temperature, likelihood for flashback and likelihood for auto-ignition than traditional fuels (e.g., fuels not containing hydrogen). That is, gaseous H2 fuels have a wider flammable range and a faster burning velocity than traditional fuels such petroleum-based fuels, or petroleum and synthetic fuel blends. These high burn temperatures of gaseous H2 fuels mean that additional insulation is needed between the ignited gaseous H2 fuel and surrounding components of the turbine engine or gas turbine engine (e.g., the dome wall, the inner/outer liner, and other parts of the turbine engine). Further, additional structure to mitigate flashback and stop undesired auto-ignition is needed; problems not faced by combustors utilizing traditional fuels. The combustor, as described herein, includes a fuel nozzle assembly that provides a layer of insulation between the flame and portions of the combustion section, keeps the mixed flow of fuel below the auto-ignition temperature, and prevents flashback from accruing within the fuel nozzle. The fuel nozzle assembly further aides in flame shaping which helps with ensuring liner wall temperature, the dome wall temperature, the combustor exit temperature profile and pattern of the flame/gas exiting the combustor can be controlled. This control or shaping can further ensure that the combustion section or otherwise hot sections of the turbine engine do not fail or otherwise become ineffective by being overly heated, thus increasing the lifespan of the turbine engine. That is, the fuel nozzle assembly, as described herein, ensure an even, uniform, or otherwise desired flame propagation within the combustor.

Benefits associated with using hydrogen-containing fuel over traditional fuels include an eco-friendlier engine as the hydrogen-containing fuel, when combusted, generates less carbon pollutants than a combustor using traditional fuels. For example, a combustor including 100% hydrogen-containing fuel (e.g., the fuel is 100% H2) would have zero carbon pollutants. The combustor, as described herein, can be used in instances where 100% hydrogen-containing fuel is used.

To the extent not already described, the different features and structures of the various embodiments can be used in combination, or in substitution with each other as desired. That is, any flame shaping hole coupling compressed air to the combustion chamber can include one or more of the aspects described herein. By way of non-limiting example, one or more flame shaping holes can include a channel or single radiused inlet fluidly coupled to one or more passages. By way of further non-limiting example, one or more flame shaping holes can include a chambered portion or at least one aperture. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. Further, the radiused inlet coupled to the passageway can be applied to any flow path providing flow through one or more portions or components of a turbine engine. That is, aspects of the disclosure are illustrated in the context of the flame shaping holes of a combustor, however, other passages within the turbine engine are contemplated. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A turbine engine comprising a compressor section, a combustion section, and a turbine section in serial fluid arrangement, the combustion section comprising a combustor liner and a dome wall collectively forming at least a portion of a combustion chamber, with the dome wall having fuel nozzle opening, and a fuel nozzle assembly extending through the fuel nozzle opening, the fuel nozzle assembly comprising a first body having a centerline axis, the first body defining a gaseous fuel channel having a gaseous fuel outlet, a second body defining a first compressed air channel having a first outlet, the first compressed air channel circumscribing at least a portion of the gaseous fuel channel, a first swirler provided within the gaseous fuel channel, and a second swirler provided within the first compressed air channel, the second swirler extending between the first body and the second body.

The turbine engine of any preceding clause, wherein the fuel nozzle assembly further comprises a third body provided at least partially radially outward from the second body.

The turbine engine of any preceding clause, wherein the third body is spaced from the second body to define a second compressed air channel therebetween.

The turbine engine of any preceding clause, wherein the second compressed air channel includes a scalloped section terminating at an inner surface, with a gap being formed between the inner surface and the second body.

The turbine engine of any preceding clause, wherein the second body is free to move radially within the gap.

The turbine engine of any preceding clause, wherein the third body includes an annular arm, and the dome wall includes an annular groove, with the annular arm being received within the annular groove.

The turbine engine of any preceding clause, wherein the annular arm and the annular groove extend continuously about an entirety of the centerline axis.

The turbine engine of any preceding clause, wherein the fuel nozzle assembly is free to move radially within the annular groove.

The turbine engine of any preceding clause, wherein the first body, the second body, the first swirler and the second swirler are integrally formed, and separate from the third body.

The turbine engine of any preceding clause, wherein the fuel nozzle assembly further comprises a third compressed air channel extending through the gaseous fuel channel, the third compressed air channel being integrally formed with the first body.

The turbine engine of any preceding clause, wherein the fuel nozzle assembly further comprises a third body provided at least partially radially outward from the second body, the combustion section comprises a set of flame shaping holes configured to exhaust a flow of compressed air into the combustion chamber and provide a footprint of a flame generated through ignition of a flow of gaseous fuel from the gaseous fuel channel, and the set of flame shaping holes are provided within the dome wall, the second body, the third body, or a combination thereof.

The turbine engine of any preceding clause, wherein the fuel nozzle assembly further comprises a first set of flame shaping holes provided within the second body, and the dome wall includes a second set of flame shaping holes provided radially outward from the first set of flame shaping holes.

The turbine engine of any preceding clause, wherein the first body, the second body, the first swirler, and the second swirler are integrally formed.

The turbine engine of any preceding clause, wherein the first body and the second body are separate from the dome wall.

The turbine engine of any preceding clause, wherein the first body includes a first angled section, and the second body includes a second angled section.

The turbine engine of any preceding clause, wherein one of the first angled section or the second angled section extends radially towards the centerline axis, while an other of the first angled section and the second angled section extends radially away from the centerline axis, or both of the first angled section and the second angled section extend either radially away from or radially toward the centerline axis.

The turbine engine of any preceding clause, wherein at least one of the first swirler or the second swirler is an orifice plate.

A method of operating the combustion section of any preceding clause, the method comprising, supplying a flow of gaseous fuel to the gaseous fuel channel, and supplying a first flow of compressed air to the first compressed air channel.

The method of any preceding clause, wherein the flow of gaseous fuel comprises one of 100% hydrogen fuel, a mixture of hydrogen fuel and another gaseous fuel, or a mixture of hydrogen fuel and compressed air.

The method of any preceding clause, further comprising supplying a second flow of compressed air to a second compressed air channel formed between the second body and a third body provided radially outward from the second body.

The turbine engine of any preceding clause, wherein the combustion section further comprising a set of flame shaping holes configured to exhaust a flow of compressed air into the combustion chamber and provide a footprint of a flame generated through ignition of a flow of gaseous fuel from the gaseous fuel channel, and the set of flame shaping holes are provided within the dome wall, the second body, the third body, or a combination thereof.

The turbine engine of any preceding clause, wherein the flame shaping holes are formed as a continuous channel extending circumferentially about an entirety of the centerline axis.

The turbine engine of any preceding clause, wherein the flame shaping holes are formed as segmented channels extending circumferentially about less than an entirety of the centerline axis.

The turbine engine of any preceding clause, wherein the flame shaping holes extend circumferentially about less than an entirety of the centerline axis.

The turbine engine of any preceding clause, wherein the flame shaping holes are formed as a plurality of circumferentially spaced holes.

The turbine engine of any preceding clause, wherein the flame shaping holes are angled radially inward, radially outward, parallel with, or a combination there with respect to the centering axis.

The turbine engine of any preceding clause, wherein the fuel nozzle assembly further comprises a third body provided at least partially radially outward from the second body.

The turbine engine of any preceding clause, wherein the third body is spaced from the second body to define a second compressed air channel therebetween.

The turbine engine of any preceding clause, wherein the second compressed air channel includes a first leg and a second leg.

The turbine engine of any preceding clause, wherein the first leg is non-parallel to the second leg.

The turbine engine of any preceding clause, wherein the second leg is formed within the third body and the first leg is formed between the third body and the second body.

A combustion section comprising a combustor liner and a dome wall collectively forming at least a portion of a combustion chamber, with the dome wall having fuel nozzle opening, and a fuel nozzle assembly extending through the fuel nozzle opening, the fuel nozzle assembly comprising a first body having a centerline axis, the first body defining a gaseous fuel channel having a gaseous fuel outlet, a second body defining a first compressed air channel having a first outlet, the first compressed air channel circumscribing at least a portion of the gaseous fuel channel, a first swirler provided within the gaseous fuel channel, and a second swirler provided within the first compressed air channel, the second swirler extending between the first body and the second body.

The combustion section of any preceding clause, wherein the fuel nozzle assembly further comprises a third body provided at least partially radially outward from the second body.

The combustion section of any preceding clause, wherein the third body is spaced from the second body to define a second compressed air channel therebetween.

The combustion section of any preceding clause, wherein the second compressed air channel includes a scalloped section terminating at an inner surface, with a gap being formed between the inner surface and the second body.

The combustion section of any preceding clause, wherein the second body is free to move radially within the gap.

The combustion section of any preceding clause, wherein the third body includes an annular arm, and the dome wall includes an annular groove, with the annular arm being received within the annular groove.

The combustion section of any preceding clause, wherein the annular arm and the annular groove extend continuously about an entirety of the centerline axis.

The combustion section of any preceding clause, wherein the fuel nozzle assembly is free to move radially within the annular groove.

The combustion section of any preceding clause, wherein the first body, the second body, the first swirler and the second swirler are integrally formed, and separate from the third body.

The combustion section of any preceding clause, wherein the fuel nozzle assembly further comprises a third compressed air channel extending through the gaseous fuel channel, the third compressed air channel being integrally formed with the first body.

The combustion section of any preceding clause, wherein the fuel nozzle assembly further comprises a third body provided at least partially radially outward from the second body, the combustion section comprises a set of flame shaping holes configured to exhaust a flow of compressed air into the combustion chamber and provide a footprint of a flame generated through ignition of a flow of gaseous fuel from the gaseous fuel channel, and the set of flame shaping holes are provided within the dome wall, the second body, the third body, or a combination thereof.

The combustion section of any preceding clause, wherein the fuel nozzle assembly further comprises a first set of flame shaping holes provided within the second body, and the dome wall includes a second set of flame shaping holes provided radially outward from the first set of flame shaping holes.

The combustion section of any preceding clause, wherein the first body, the second body, the first swirler, and the second swirler are integrally formed.

The combustion section of any preceding clause, wherein the first body and the second body are separate from the dome wall.

The combustion section of any preceding clause, wherein the first body includes a first angled section, and the second body includes a second angled section.

The combustion section of any preceding clause, wherein one of the first angled section or the second angled section extends radially towards the centerline axis, while an other of the first angled section and the second angled section extends radially away from the centerline axis, or both of the first angled section and the second angled section extend either radially away from or radially toward the centerline axis.

The combustion section of any preceding clause, wherein at least one of the first swirler or the second swirler is an orifice plate.

A method of operating the combustion section of any preceding clause, the method comprising, supplying a flow of gaseous fuel to the gaseous fuel channel, and supplying a first flow of compressed air to the first compressed air channel.

The method of any preceding clause, wherein the flow of gaseous fuel comprises one of 100% hydrogen fuel, a mixture of hydrogen fuel and another gaseous fuel, or a mixture of hydrogen fuel and compressed air.

The method of any preceding clause, further comprising supplying a second flow of compressed air to a second compressed air channel formed between the second body and a third body provided radially outward from the second body.

The combustion section of any preceding clause, further comprising a set of flame shaping holes configured to exhaust a flow of compressed air into the combustion chamber and provide a footprint of a flame generated through ignition of a flow of gaseous fuel from the gaseous fuel channel, and the set of flame shaping holes are provided within the dome wall, the second body, the third body, or a combination thereof.

The combustion section of any preceding clause, wherein the flame shaping holes are formed as a continuous channel extending circumferentially about an entirety of the centerline axis.

The combustion section of any preceding clause, wherein the flame shaping holes are formed as segmented channels extending circumferentially about less than an entirety of the centerline axis.

The combustion section of any preceding clause, wherein the flame shaping holes extend circumferentially about less than an entirety of the centerline axis.

The combustion section of any preceding clause, wherein the flame shaping holes are formed as a plurality of circumferentially spaced holes.

The combustion section of any preceding clause, wherein the flame shaping holes are angled radially inward, radially outward, parallel with, or a combination there with respect to the centering axis.

The combustion section of any preceding clause, wherein the fuel nozzle assembly further comprises a third body provided at least partially radially outward from the second body.

The combustion section of any preceding clause, wherein the third body is spaced from the second body to define a second compressed air channel therebetween.

The combustion section of any preceding clause, wherein the second compressed air channel includes a first leg and a second leg.

The combustion section of any preceding clause, wherein the first leg is non-parallel to the second leg.

The combustion section of any preceding clause, wherein the second leg is formed within the third body and the first leg is formed between the third body and the second body.

What is claimed is:

1. A turbine engine comprising:

a compressor section, a combustion section, and a turbine section in serial fluid arrangement, the combustion section comprising:

a combustor liner and a dome wall collectively forming at least a portion of a combustion chamber, with the dome wall having a fuel nozzle opening; and a fuel nozzle assembly extending through the fuel nozzle opening, the fuel nozzle assembly is fluidly coupled to a flow of gaseous fuel, the fuel nozzle assembly comprising:

a first body having a centerline axis, the first body defining a gaseous fuel channel having a gaseous fuel outlet, wherein the gaseous fuel channel is fluidly coupled to the flow of gaseous fuel, and wherein the gaseous fuel outlet terminates in a distal end;

a second body defining a first compressed air channel having a first outlet, the first compressed air channel circumscribing at least a portion of the gaseous fuel channel;

a first swirler provided within the gaseous fuel channel, wherein the gaseous fuel outlet of the first body is located downstream of the first swirler, and wherein the gaseous fuel outlet of the first body includes an inner wall which expands radially outward in a direction from upstream to downstream;

a second swirler provided within the first compressed air channel, the second swirler extending between the first body and the second body, wherein the first outlet of the second body is located downstream of the second swirler, and wherein the first outlet of the second body includes an inner wall which expands radially outward in a direction from upstream to downstream; and a third compressed air channel centrally extending through the first swirler, the third compressed air channel having a distal end that is axially aligned with the distal end of the gaseous fuel outlet.

2. The turbine engine of claim 1, wherein the fuel nozzle assembly further comprises a third body provided at least partially radially outward from the second body.

3. The turbine engine of claim 2, wherein the third body is spaced from the second body to define a second compressed air channel therebetween and wherein the third body is sealingly coupled to the dome wall.

4. The turbine engine of claim 2, wherein the third body includes an annular arm, and the dome wall includes an annular groove, with the annular arm being received within the annular groove.

5. The turbine engine of claim 4, wherein the annular arm and the annular groove extend continuously about an entirety of the centerline axis.

6. The turbine engine of claim 4, wherein the fuel nozzle assembly is free to move radially within the annular groove.

7. The turbine engine of claim 2, wherein the first body, the second body, the first swirler and the second swirler are integrally formed, and separate from the third body.

8. The turbine engine of claim 2, wherein, the third compressed air channel is integrally formed with the first body.

9. The turbine engine of claim 1, wherein:

the fuel nozzle assembly further comprises a third body provided at least partially radially outward from the second body;

the combustion section comprises a set of flame shaping holes configured to exhaust a flow of compressed air into the combustion chamber and provide a footprint of a flame generated through ignition of a flow of gaseous fuel from the gaseous fuel channel; and wherein the set of flame shaping holes are provided within the dome wall, the second body, the third body, or a combination thereof.

10. The turbine engine of claim 9, wherein the set of flame shaping holes comprises a first set of flame shaping holes provided within the second body, and the dome wall includes a second set of flame shaping holes provided radially outward from the first set of flame shaping holes.

11. The turbine engine of claim 1, wherein the first body, the second body, the first swirler, and the second swirler are integrally formed.

12. The turbine engine of claim 1, wherein the first body and the second body are separate from the dome wall.

13. A method of operating the turbine engine of claim 1, the method comprising:

supplying a flow of gaseous fuel to the gaseous fuel channel; and supplying a first flow of compressed air to the first compressed air channel.

14. The method of claim 13, wherein the flow of gaseous fuel comprises one of 100% hydrogen fuel, a mixture of hydrogen fuel and another gaseous fuel, or a mixture of hydrogen fuel and compressed air.

15. The method of claim 13, further comprising supplying a second flow of compressed air to a second compressed air channel formed between the second body and a third body provided radially outward from the second body.

* * * * *